US008028492B2

(12) United States Patent
Grypeos

(10) Patent No.: US 8,028,492 B2
(45) Date of Patent: Oct. 4, 2011

(54) UPRIGHT SUPPORT MEMBER FOR AN INSULATING SHEET OF A WALL HAVING AN INTERNAL CAVITY

(76) Inventor: Anastasios Grypeos, Seattle, WA (US)

( * ) Notice: Subject to any disclaimer, the term of this patent is extended or adjusted under 35 U.S.C. 154(b) by 1032 days.

(21) Appl. No.: 11/744,716

(22) Filed: May 4, 2007

(65) Prior Publication Data

US 2008/0271401 A1 Nov. 6, 2008

(51) Int. Cl.
*E04C 3/46* (2006.01)
*E04B 2/06* (2006.01)

(52) U.S. Cl. ..... 52/837; 52/435

(58) Field of Classification Search ..... 52/837, 52/855, 426, 434, 435, 442, 309.9, 309.11, 52/309.12, 309.15, 309.17, 762, 764, 780, 52/781; 264/31, 35
See application file for complete search history.

(56) References Cited

U.S. PATENT DOCUMENTS

| | | | | |
|---|---|---|---|---|
| 1,650,311 | A * | 11/1927 | Whittredge | 52/481.2 |
| 2,438,140 | A * | 3/1948 | Auten | 52/464 |
| 5,611,182 | A | 3/1997 | Spude | |
| 5,744,076 | A * | 4/1998 | Baxter | 264/35 |
| 5,809,726 | A | 9/1998 | Spude | |
| 6,026,620 | A | 2/2000 | Spude | |
| 6,119,430 | A * | 9/2000 | Nicholls | 52/846 |
| 6,134,861 | A | 10/2000 | Spude | |
| 6,434,902 | B1 * | 8/2002 | Westra | 52/309.17 |

FOREIGN PATENT DOCUMENTS

| | | |
|---|---|---|
| DE | 2454182 | 5/1976 |
| WO | 2005/019552 | 3/2005 |

OTHER PUBLICATIONS

Quad-Lock Building Systems, Design and Construction Details, *Product Manual 17-46*, Parts 1 and 2, Section 2, Dec. 2004.
Premere Insulated Concrete Forms, Premere Forms ICF Guide, *Section A Set Up Procedures* A1-A15, Jan. 11, 2005.
Premere Insulated Concrete Forms, Premere Forms ICF Guide, *Section B Reference*,B1-B13 Jan. 11, 2005.
TF System®, Section 1, *Introduction to TF System* 9-17, Rev. Nov. 1, 2004.
TF System®, Section 3, *Basic Installation*, 29-37, Rev. Nov. 1, 2004.

* cited by examiner

*Primary Examiner* — Michael Safavi
(74) *Attorney, Agent, or Firm* — Davis Wright Tremaine LLP; George C. Rondeau, Jr.; Heather M. Colburn

(57) ABSTRACT

A wall-forming system including a pair of spaced apart confronting sidewalls defining a wall cavity therebetween. Each sidewall is constructed from a plurality of insulating sheets and upright support members. Each sheet is disposed between a neighboring pair of support members. Each of the neighboring support members has an upright channel that receives an end wall portion of the sheet and thereby maintains the sheet upright. Each support member also includes a slot for receiving one end of a tie that extends between the first and second sidewalls through the wall cavity and connects the first sidewall to the second sidewall. The slot is defined between a pair of walls having a plurality of through-holes extending transversely therethrough and across the slot. The end of the tie disposed inside the slot has a through-hole aligned with one of the through-holes of the walls to receive a portion of a fastener therein.

7 Claims, 23 Drawing Sheets

UPRIGHT SUPPORT MEMBER FOR AN INSULATING SHEET OF A WALL HAVING AN INTERNAL CAVITY

BACKGROUND OF THE INVENTION

1. Field of the Invention

The present invention is directed generally to systems for and methods of forming walls or other structures from materials, such as cement, that are poured into molds or forms in a liquid state and subsequently harden to a solid state therein, and more particularly to methods and systems for forming insulated and/or reinforced concrete walls.

2. Description of the Related Art

Many buildings have walls including a wall material, such as cement, that transitions from a liquid state to a solid state by drying, curing, and/or cooling. The wall may be constructed by pouring the wall material into a wall forming structure or system where the wall material solidifies to form a solid wall. To add strength to these walls, solid reinforcement materials, such as glass fibers or chopped wires, and/or reinforcement structures such as steel wires or bars may be added to the liquid wall material before it solidifies. After the wall material solidifies, the reinforcement materials are embedded therein. The reinforcement materials may include reinforcement bars, also known as rebar, used to construct an internal structure inside the wall. Concrete walls having an internal rebar structured embedded therein are often referred to as "reinforced concrete walls."

Reinforced walls, such as reinforced concrete walls, resist deformation by transferring stress from the wall material to the embedded reinforcement materials. As a general rule, each of the individual wires or bars embedded in the wall material resist tensile stress in the direction of their longitudinal axis. Because tensile stress may occur in several directions, the reinforcement materials and/or structures constructed therefrom may include longitudinal members oriented along more than one direction.

For example, referring to FIG. 1A, a plurality of reinforcement bars 2 may be assembled (e.g., wired together) to form a two-dimensional grid-like structure 10. More than one two-dimensional grid-like structure 10 may be embedded in the wall material. For example, referring to FIG. 1B, the two-dimensional grid-like structures 10 may be coupled together to form a three-dimensional grid-like structure 20, sometimes referred to as a "cage."

Referring to FIGS. 1A and 1B, in typical wall construction, the two-dimensional grid-like structure 10 or three-dimensional grid-like structure 20 rests upon a concrete footing 30. The grid-like structures 10 and 20 may be connected to rebar embedded in the footing 30 and exiting the top surface thereof, and/or attached to the footing 30 by other connectors known in the art.

During construction, the plurality of reinforcement bars 2 are typically disposed within a wall forming structure or system and the liquid wall material is poured into the form and cast around them. The wall forming structure or system may be constructed from sheet materials such as wood, metal, cast stone, styrofoam, cast Styrofoam, and the like. Generally speaking, the concrete or similar material may be poured between two confronting and spaced apart vertical sheets that are tied together in a transverse direction by a plurality of walers or ties. The sheet materials remain in place after the wall material has solidified and form layers of insulation along each face of the insulated wall.

Because wall materials are often hard and difficult to penetrate, it may be desirable to fasten attachment members or similar structures to one or both faces of the solidified wall material. If the face of the wall includes a layer of insulation, the insulation may be too soft to use as an attachment member. Further, attaching materials to the layer of insulation may damage it.

The attachment members may include strips of material such as wood, plastic, and the like that are softer than the wall material. If the wall includes an insulation layer installed along one or both faces, the attachment members may be harder than the insulating material and anchored to the wall material. The attachment members may include a portion that was introduced into the wall material while the wall material was in its liquid state. In this manner, the portion of the attachment member may be embedded in the wall material after it hardens and thereby anchored to the wall. Alternatively, the attachment members may be coupled to structures, such as ties, that are embedded in the hardened wall material before or after the liquid wall material is added to the wall forming structure or system and subsequently hardens. Alternatively, the attachment strips may be fastened to the face of the wall by glue, staples, nails, screws, and the like. Wall components such as siding, drywall, sheet insulation, and the like may be anchored to one or both faces of the wall by fastening the wall components to the attachment members.

In most wall-forming systems, the sheet materials are uprighted and maintained in place by support members. Several support member designs may be found in the prior art. For example, TFSYSTEM® insulated cement forms (Wisconsin Thermo-Form, Inc., 185 East Walnut St., Sturgeon, Wis. 54235) include a ladder-shaped elongated upright support member having an I-beam cross-sectional shape. The I-beam cross-sectional shape includes two substantially parallel flanges connected by a transverse member that is substantially perpendicular to both of the flanges. As mentioned above, the wall forming system may be constructed by arranging the insulating sheets into two confronting and spaced apart walls forming a cavity therebetween and tied together by a plurality of ties traversing the cavity. With respect to the TFSYSTEM® insulated cement forms, each of the insulating sheets is taller than it is wide and is approximately of equal height to the support members. The insulating sheets each include two opposing vertically extending end walls, each having a longitudinal slit extending inwardly from the end wall. The longitudinal slit extends along the entire length of the end wall and is open at both ends.

When the insulating sheets are arranged to form one of the walls of the wall forming system, one of the end walls of a first insulation sheet is placed adjacent to one of the end walls of a second insulation sheet and the longitudinal slit in the end wall of the first insulation sheet is placed adjacent to the longitudinal slit in the end wall of the second insulation sheet. The flanges of the I-beam are sized and shaped to be received into the adjacent longitudinal slits simultaneously. A portion of the end wall of the first insulation sheet is separated from a portion of the end wall of the second insulating sheet by a portion of the transverse member.

Each of the insulating sheets of the other of the wall of the wall forming system may be slid between neighboring support members by placing the insulation sheet atop the neighboring support members, aligning the slits of the insulation sheet with the flanges of the neighboring support members, and lowering the insulation sheet between the neighboring support members and thereby receiving the flanges inside the slits. Alternatively, the first and second walls of the wall forming system may be constructed simultaneously. The walls of the wall forming system are connected across the cavity by the transverse members of the support members.

The TFSYSTEM® insulated cement form system has several drawbacks. First, support members cannot be used to construct a wall forming system around a preexisting internal structure such as the two-dimensional grid-like structure 10 or the three-dimensional grid-like structure 20. Second, the end walls of the insulating sheets must be modified to include longitudinal slits. Third, special corner insulating sheets must be used to construct corners in the finished wall. Fourth, the flanges of the support members are embedded in the insulating sheets and cannot be used as attachment members.

Other prior art wall forming systems include Premere Insulating Concrete Forms (Premere Forms, Inc., 2309 West 50th Street, Sioux Falls, S. Dak. 57105-6568). The Premere Insulating Concrete Forms use rectangular insulating sheets that are oriented horizontally. An I-beam shaped elongated support member is positioned between neighboring insulating sheets. The support members of the first wall of the wall forming system are juxtaposed with the support members of the second wall of the wall forming system.

The I-beam shaped member includes an inside flange, an outside flange, and a transverse member extending therebetween. The transverse member has two planar sides, a top side, and a bottom side. One end wall of a first sheet is received into a first recess formed between the inside flange, the outside flange, and the first side of the transverse member. One end wall of a neighboring second sheet is received into a second recess formed between the inside flange, the outside flange, and the second side of the transverse member. In this manner, the outside flange is disposed along the outside face of the wall of the wall forming system and the inside flange is disposed inside the cavity.

The inside flange is disposed within the cavity and includes a rail having a generally arrow-shaped cross-section. A plurality of elongated ties having a fastener configured to receive, clamp, and hold the generally arrow-shaped rail are fastened between the rails of the first and second walls of the wall forming system. The fasteners may be snapped into place along the rail. The ties should be snapped onto a pair of rails (and thereby forming a ladder-shaped support member) before the support members are incorporated into the first and second walls of the wall forming system.

The Premere Insulating Concrete Forms have significant drawbacks. First, if the ties are attached to the support members before installation into the first and second walls, the Premere Insulating Concrete Forms cannot be used to construct a wall forming system around preexisting internal structures such as the two-dimensional grid-like structure 10 or the three-dimensional grid-like structure 20. Second, if the ties are to be snapped to the rails of the support members after installation into the wall forming system and the first and second walls of the wall forming system are not sufficiently parallel, snapping the ties to each of the rails across the cavity may be difficult, if not impossible. This becomes increasingly more difficult as the first and second walls increase in size and correspondingly weight. Third, the ties may slide along the rails. Consequently, the rails cannot be placed in an upright orientation or gravity will cause the ties to slide to the bottom of the wall-forming cavity between the first and second walls. Some types of elongated wall components, such as wood siding, vinyl siding, and the like, cannot be mounted to the horizontally extending outside flanges that form attachment members along the outside surface of the wall. Consequently, vertically extending strips must be attached to the outside flanges to provide an anchoring surface to which to mount such wall components. Attaching the vertically extending strips increases the expense and time required to construct the wall.

Another prior art system includes Quad-Lock Insulated Concrete Forms (Quad-Lock Building Systems Ltd., 7398-132nd Street, Surrey, BC V3W 4M7, Canada). This wall forming system includes a pair of identical and connected I-beam shaped support members each having a first flange, a second flange, and a transverse member extending between the first and second flanges. The support members are connected together by two spaced apart connecting members extending between the transverse members of the support members. Like the structure of the TFSYSTEM® insulated cement form system, the flanges of the support members are received into slits formed in an end wall of the insulating sheets. However, each of the connected I-beam support members extends only a short distance along the length of the insulating sheet. The insulating sheets also include projections formed along the same end walls as the slits. An elongated plate including apertures sized and spaced to receive the projections is attached to the end walls of the insulated sheets. Like the TFSYSTEM® insulated cement form system, this system has the drawback of requiring insulating sheets with slits formed in two opposing end walls and has the further drawback of requiring the formation of projections in those same end walls.

Therefore, a need exists for improved methods of constructing insulated walls. A need also exists for a wall forming system that does not require custom or modified insulating sheets. Further, a need exists for wall forming systems that may be constructed around reinforcement materials and/or structures. A need also exists for a wall forming system that allows the ties connecting the insulating sheets on opposite sides of the cavity to be readily connected to the insulating sheets.

BRIEF DESCRIPTION OF THE SEVERAL VIEWS OF THE DRAWING(S)

DETAILED DESCRIPTION OF THE INVENTION

Figure 2:
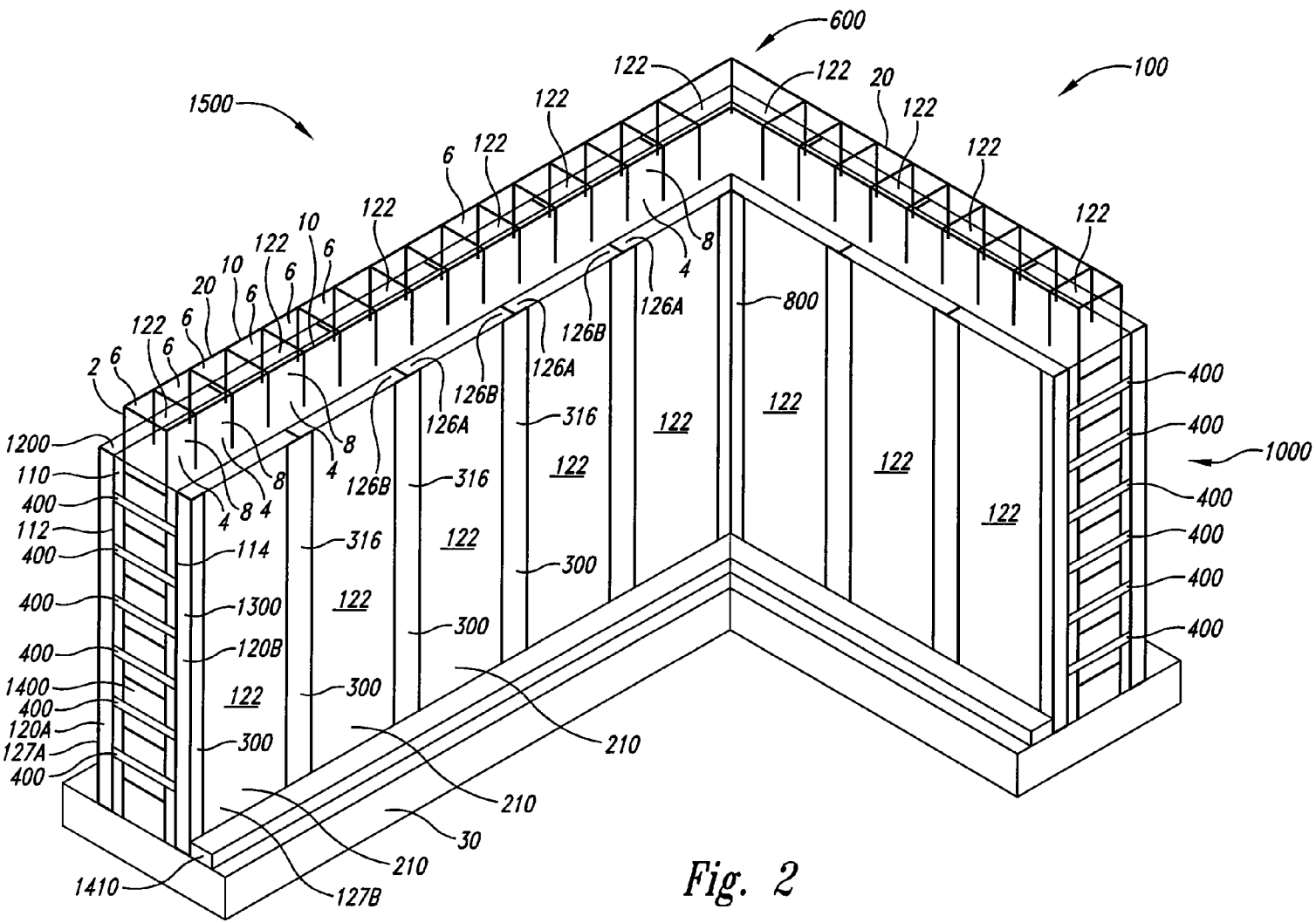
FIG. 2 is a perspective view of an insulated wall constructed in accordance with the present invention.

Aspects of the present invention relate to a wall forming system 1000 for constructing an insulated wall 100. Referring to FIG. 2, the insulated wall 100 includes a wall material 110, such as cement, which transitions from a liquid state to a solid state by drying, curing, and/or cooling. The wall material 110 may be poured, sprayed, or otherwise inserted into a wall forming system 1000 where it solidifies.

The wall material 110 includes an outward facing first face 112 and an opposite outward facing second face 114. The insulated wall 100 may include an insulating layer along one or both of the first and second faces 112 and 114. In the embodiment depicted in FIG. 2, the insulated wall 100 includes a first insulating layer 120A along the first face 112 and a second insulating layer 120B along the second face 114. Each of the insulating layers 120A and 120B includes an outwardly facing outside surface 127A and 127B, respectively.

Figure 11:
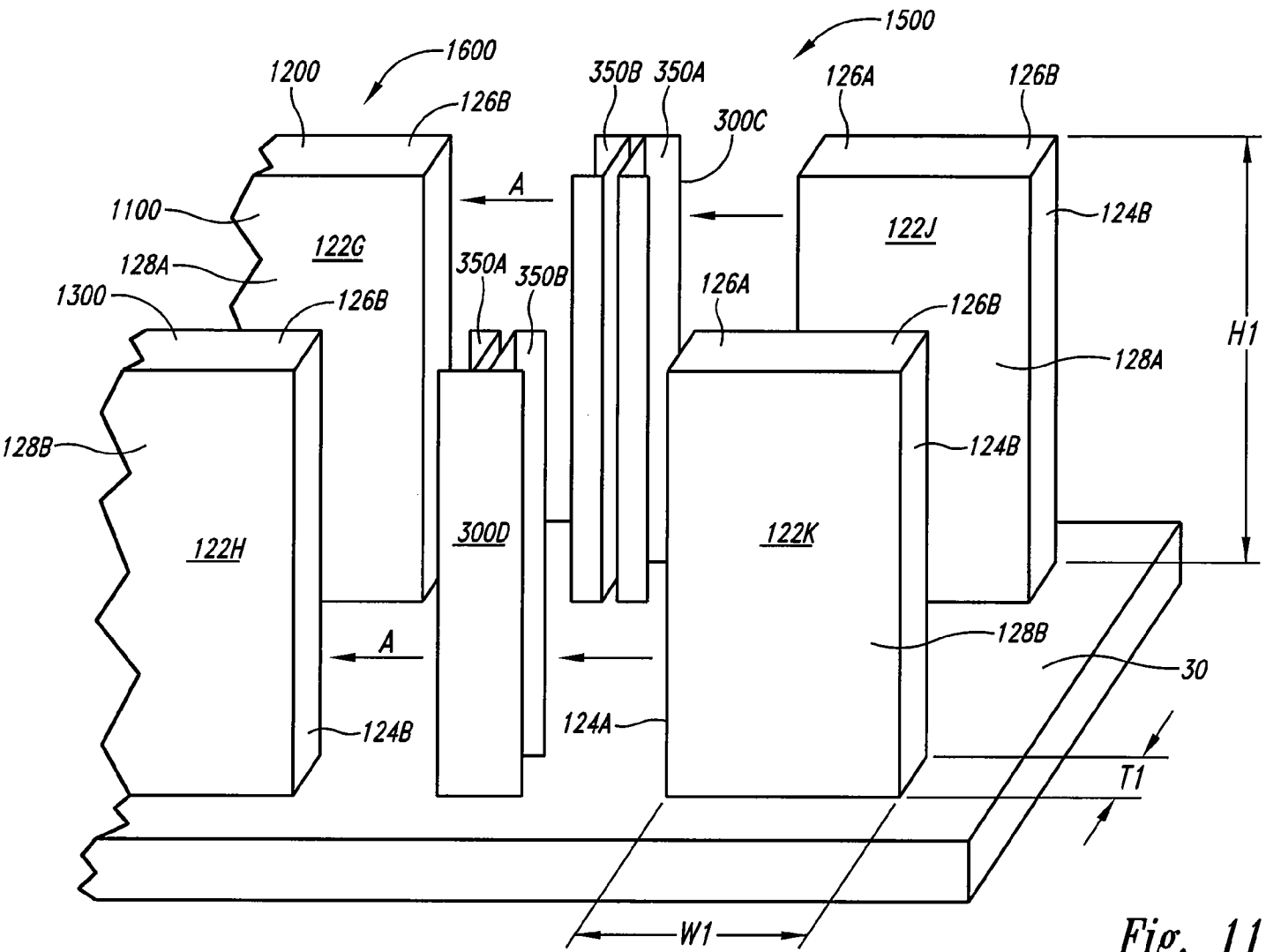
FIG. 11 is an exploded perspective view of a linear wall section of the wall forming system of FIG. 9 assembled by the method of FIG. 10, the ties and reinforcement materials having been omitted to provide a better view of aspects of the linear wall section.

Each of the insulating layers 120A and 120B may include a plurality of insulating sheets 122 disposed along both the first face 112 and the second face 114 of the wall material 110. Referring to FIG. 11, each of the insulating sheets 122, indicated by reference numbers 122G, 122H, 122J and 122K, may have a substantially rectangular shape with a height "H1" that is greater than their width "W1." Each of insulating sheets 122 sheets has a first end wall 124A extending along the direction defining the height of the insulating sheet 122 and a second end wall 124B opposing the first end wall 124A. Each of the insulating sheets 122 includes an inwardly facing inside face 128A and an outwardly facing outside face 128B. The outside face 128B of each of the insulating sheets 122 forms a portion of the outside surfaces 127A and 127B of the insulating layers 120A and 120B, respectively.

In some embodiments, the height "H1" of the insulating sheets 122 may be substantially equal to the height of the wall material 110. In various embodiments, the height "H1" of the insulating sheets 122 is about 250 cm to about 400 cm and the width "W1" of the insulating sheets 122 is about 20 cm to about 40 cm. In particular embodiments, the width "W1" of the insulating sheets 122 is about 30 cm. In particular embodiments, the insulating sheets 122 have a thickness "T1" of about 5 cm. The insulating sheets 122 may be constructed using any material known in the art including wood, metal, cast stone, cast styrofoam, Styrofoam, and the like.

Returning to FIG. 2, a plurality of upright elongated support members 300 may be disposed between neighboring insulating sheets 122 along each of the first and second faces 112 and 114 of the wall material 110. As shown in FIG. 11, end portions 126A and 126B of the insulating sheets 122 at the end walls 124A and 124B, respectively, thereof may be retained by one of the support members 300 as shown in FIG. 2.

Figure 3A:
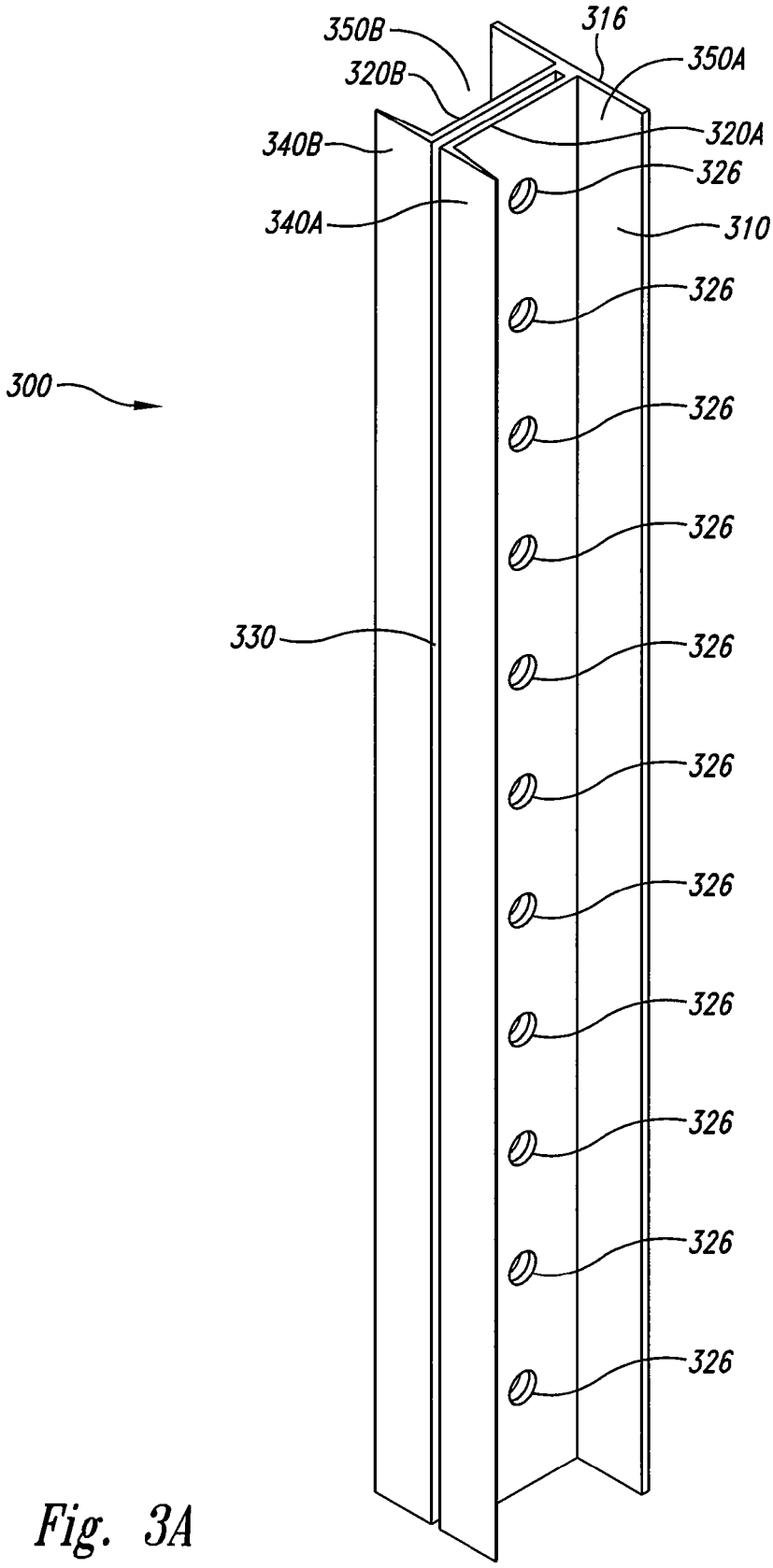
FIG. 3A is a perspective view of an inside portion of a support member of the insulated wall of FIG. 2.
Figure 3B:
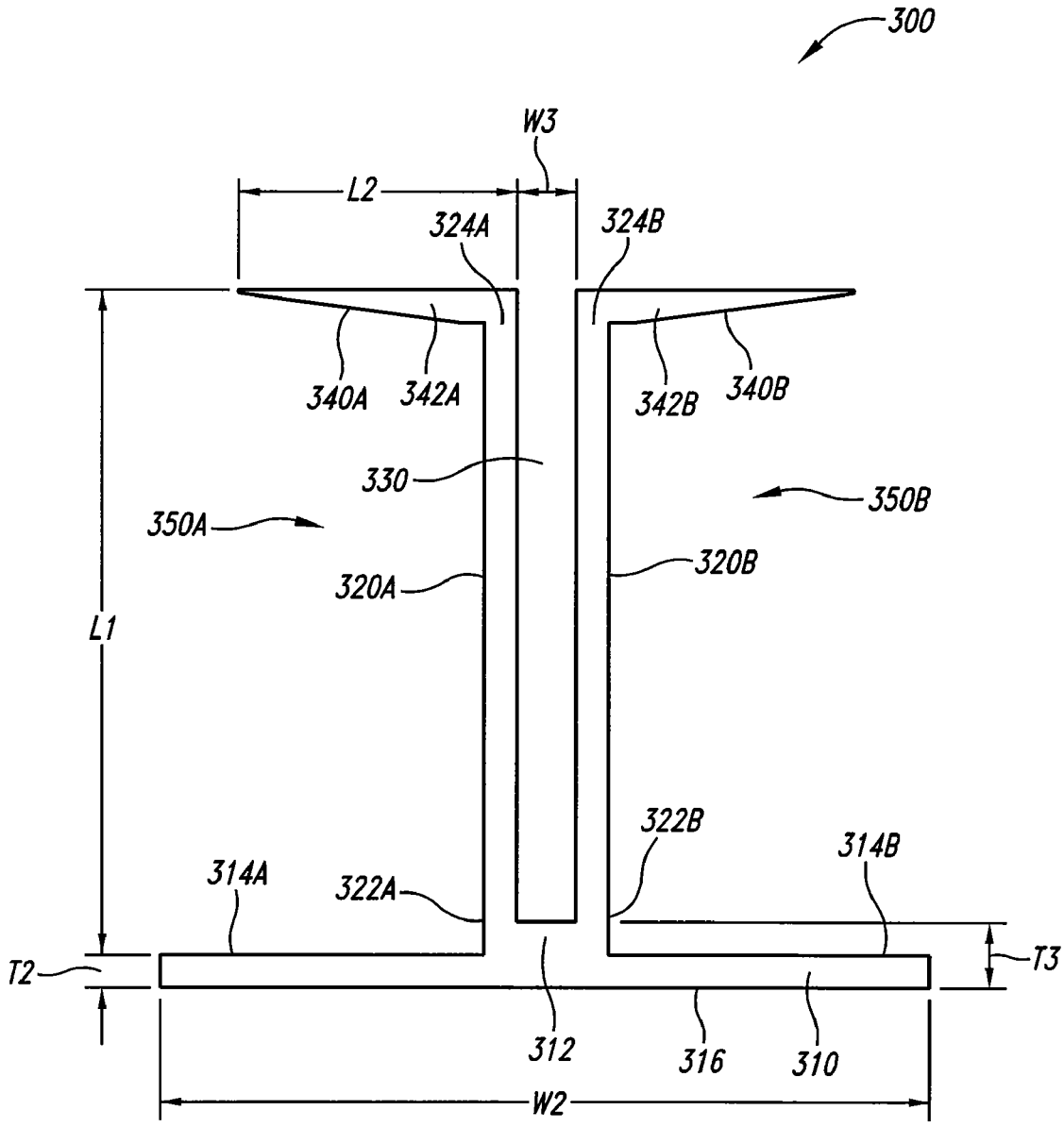
FIG. 3B is a top plan view of the support member of FIG. 3A.
Figure 3C:
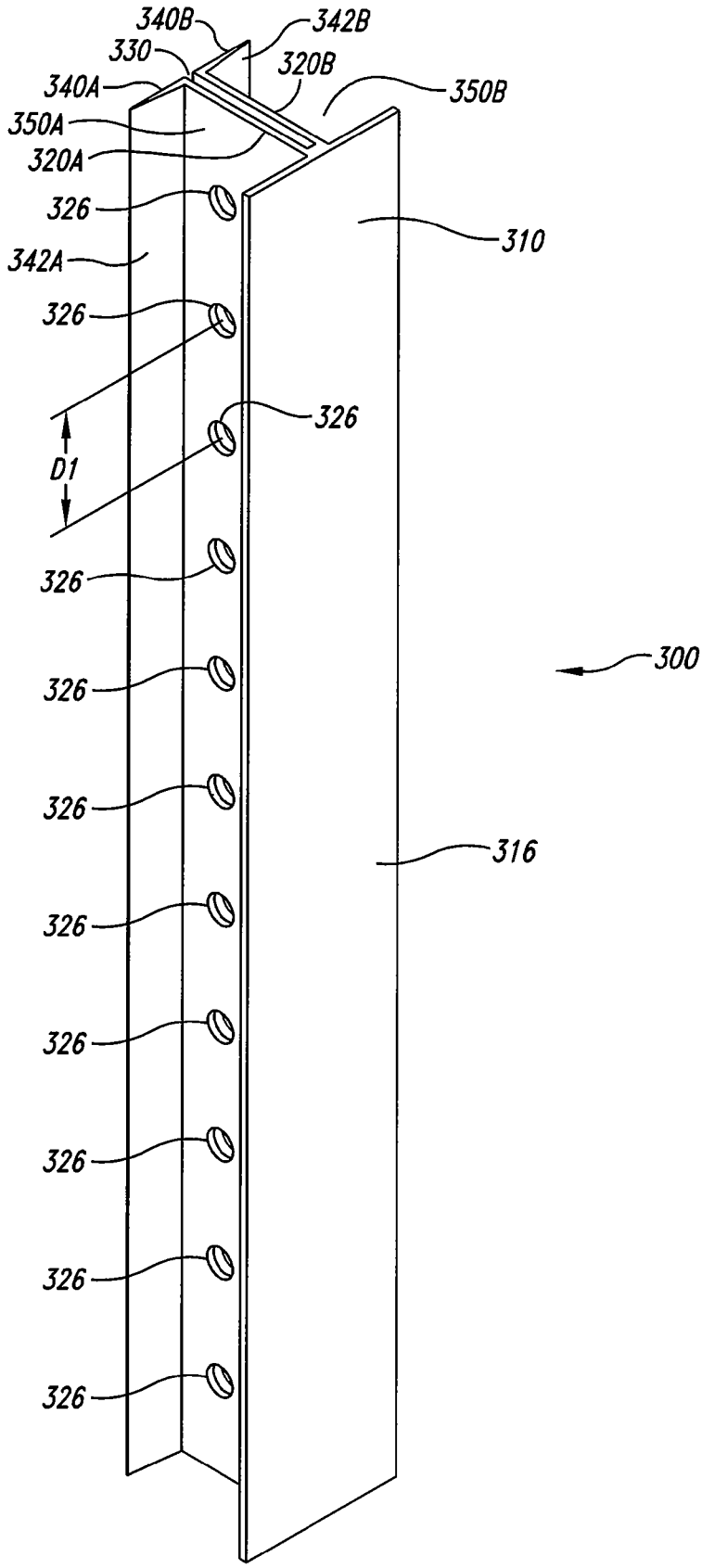
FIG. 3C is a perspective view of an outside portion of the support member of FIG. 3A.

Referring to FIGS. 3A-3C the structure of the support member 300 will now be described. Each of the support members 300 includes an elongated planar outer member 310, shown as a plate formed by two coplanar contiguous flange portions 314A and 314B, oriented along the longitudinal axis of the support member 300. The outer member 310 may have a width "W2" of about 5 cm to about 10 cm and preferably about 6.7 cm. The outer member 310 may have a thickness "T2" of about 0.1 cm to about 0.3 cm and preferably about 0.2 cm.

Each of the support members 300 includes a pair of spaced apart central walls 320A and 320B. The walls 320A and 320B bifurcate the outer member 310 into its portions 314A and 314B. The portion 314A is adjacent to the wall 320A and the portion 314B is adjacent to the wall 320B. Each of the walls 320A and 320B has a proximal end 322A and 322B and a distal end 324A and 324B, respectively. The walls 320A and 320B may be integrally formed with the outer member 310 and connected thereto by their proximal ends 322A and 322B. The distal ends 324A and 324B of the walls 320A and 320B, respectively, may extend away from the outer member 310 in a direction substantially orthogonal to the outer member 310. Each of the walls 320A and 320B may have a length "L1" of about 4.8 cm to about 5.4 cm and preferably about 5.2 cm.

A slot 330 is defined between the walls 320A and 320B. The slot 330 may have a width "W3" of about 0.2 cm to about 0.4 cm and preferably about 0.3 cm. The outer member 310 may have a portion 312 located between the proximal ends of proximal ends 322A and 322B of the walls 320A and 320B that has an increased thickness "T3." The thickness "T3" may be about 0.3 cm to about 0.5 cm and preferably about 0.4 cm.

Each of the support members 300 further includes an inner member 340A and inner member 340B, each attached to one of the walls 320A and 320B, respectively, shown as two laterally outward tapered plates formed by two coplanar spaced apart flanges, oriented along the longitudinal axis of the support member 300. The inner members 340A and 340B may be integrally formed with the walls 320A and 320B at the distal ends 324A and 324B thereof, respectively. The inner members 340A and 340B extend away from each other and the slot 330. In various embodiments, the inner members 340A and 340B extend away from one another in a direction that is substantially parallel to the outer member 310. In the embodiment depicted in the drawings, each of the inner members 340A and 340B include a tapered inside surface 342A and 342B, respectively. The tapered surfaces 342A and 342B reduce the thickness of the inner members 340A and 340B, respectively, in a direction extending away from the distal ends 324A and 324B of the walls 320A and 320B, respectively. Each of the inner members 340A and 340B may have a length "L2" of about 2.2 cm to about 2.8 cm and preferably about 2.5 cm.

An open channel 350A is defined between the portion 314A of the outer member 310, the wall 320A, and the inner member 340A. An open channel 350B is defined between the portion 314B of the outer member 310, the wall 320B, and the inner member 340B. The channels 350A and 350B are sized and shaped to receive one of the end portions 126A and 126B of one of the insulating sheets 122.

The walls 320A and 320B may include a plurality of corresponding pairs of through-holes 326 that extend through each of the walls 320A and 320B. The through-holes 326 may have a substantially circular cross-sectional shape. The distance "D1" between their centers along the longitudinal axis of the support member 300 may be about 20 cm to about 40 cm and preferably about 30 cm.

Figure 5:
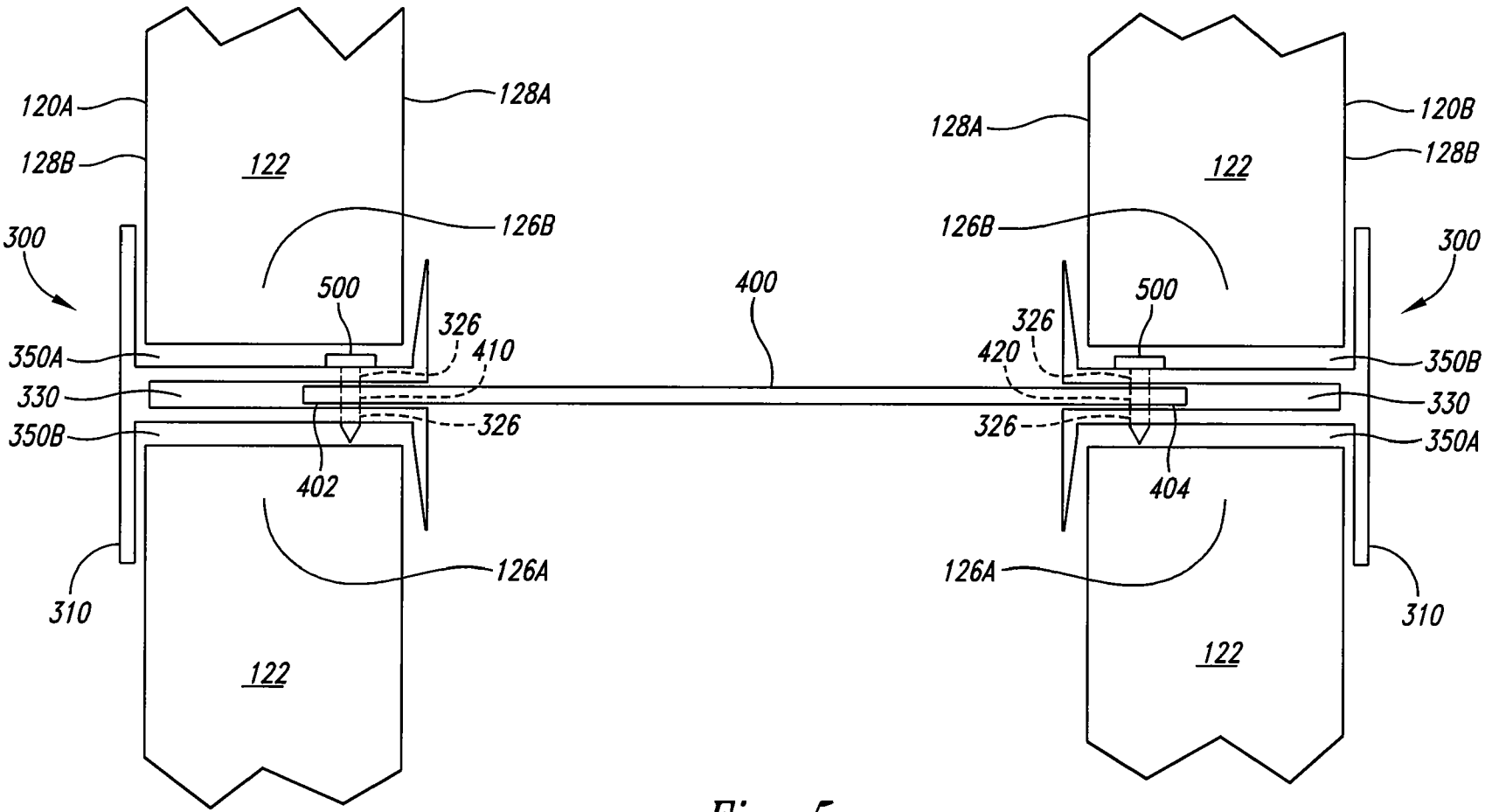
FIG. 5 is a top view of an assembly constructed by connecting a pair of the support members of FIG. 3A with a plurality of the ties of FIG. 4.

Referring to FIG. 5, each of the through-holes 326 is sized and shaped to receive a fastener 500. The fastener 500 may include any fastener 500 known in the art including plastic screws, metal screws, bolts, pins, and the like.

The inner members 340A and 340B of the support members 310 are positioned adjacent to one of the first or second faces 112 or 114 of the wall material 110 and the outer member 310 thereof forms an attachment portion 316 that is positioned adjacent to one of the outside surfaces 127A or 127B of the insulating layer 120A or 120B, respectively, of the insulated wall 100. As best shown in FIG. 5, the end portions 126A and 126B of a pair of adjacent ones of the insulating sheets 122 are received within the channels 350B and 350A, respectively, with the outside face 128B of each toward the support member 310 and the inside face 128A of each toward the inner members 340A and 340B. A portion of the support members 300 along the outside surface 127A has a correspondingly positioned support member 300 located along the outside surface 127B.

The insulated wall 100 includes a plurality of walers or ties 400 (see FIG. 4) embedded in the wall material 110. The ties 400 connect a portion of the support members 300 along the outside surfaces 127A to a correspondingly positioned support member 300 located along the outside surface 127B. Approximately 6 to 12, and preferably about 10 ties 400 connect a single support member 300 along the first face 112 of the insulated wall 100 to a corresponding support member 300 along the second face 114 of the insulated wall 100.

Figure 1B:
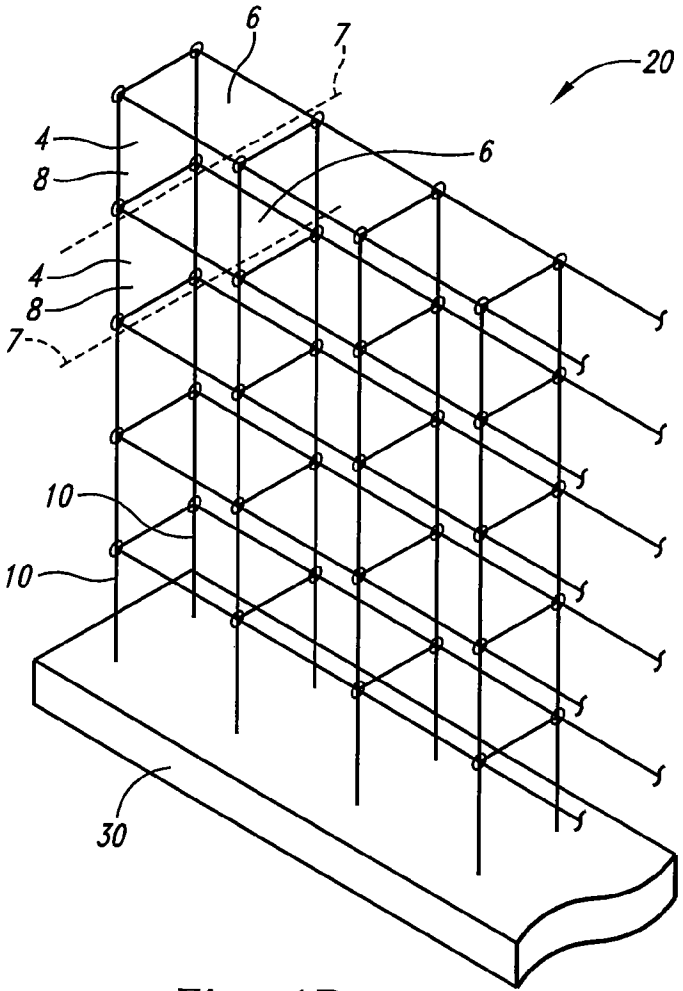
Fig. 1B (Prior Art)
FIG. 1B is a perspective elevational view of a prior art three-dimensional grid-like structure constructed using reinforcement bar.
Figure 1A:
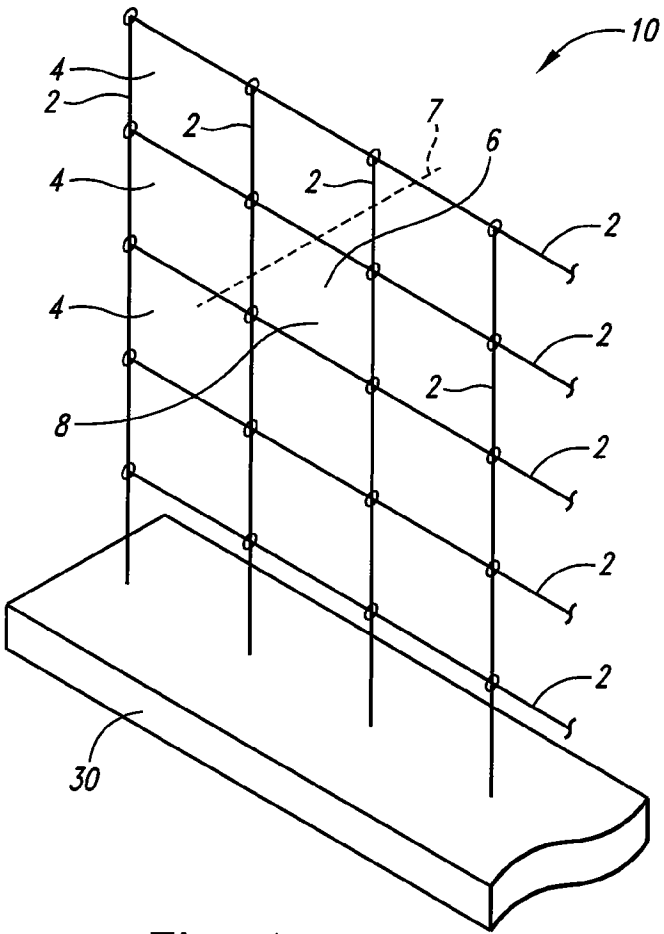
Fig. 1A (Prior Art)
FIG. 1A is a perspective elevational view of a prior art two-dimensional grid-like structure constructed using reinforcement bar.
Figure 4:
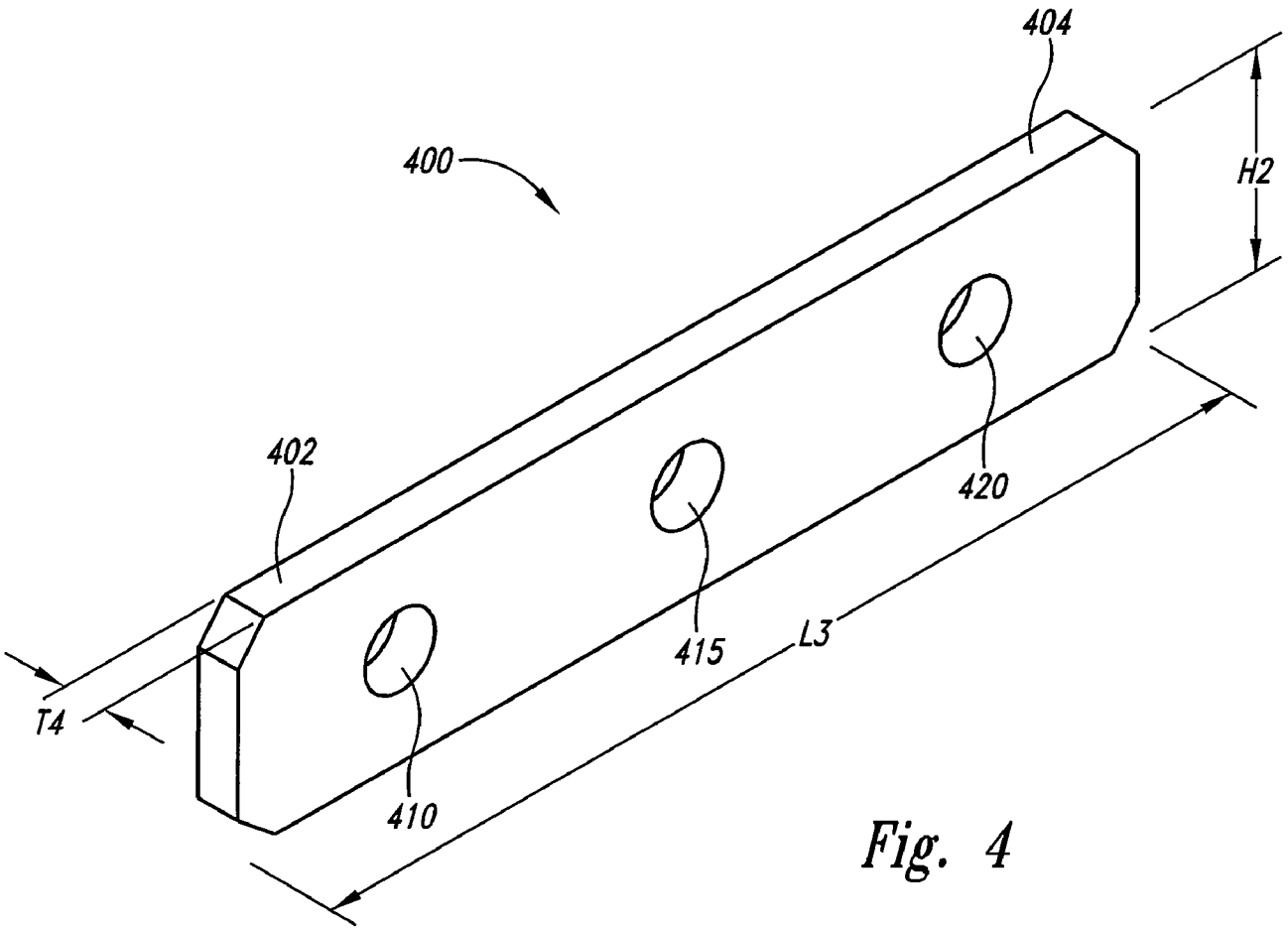
FIG. 4 is a perspective view of a tie of the insulated wall of FIG. 2.

Referring to FIG. 4, the structure of the ties 400 will now be described. The ties 400 may have a generally rectangular shape. The corners of the ties 400 may be relieved, rounded, or chamfered. Each of the ties 400 has a first end 402 that opposes a second end 404. Each of the ties 400 may include a first through-hole 410 located near the first end 402 and a second through-hole 420 located near the second end 404. Optionally, each of the ties 400 may include at least one through-hole 415 located between the first through-hole 410 and second through-hole 420. The through-hole(s) 415 may be used to secure the tie 400 to one or more of the reinforcement bars 2 (see FIGS. 1A and 1B) of the two-dimensional grid-like structure 10, the three-dimensional grid-like structure 20, and the like disposed between the first insulating layer 120A and the second insulating layer 120B. For example, a section of wire (not shown) may be threaded through the through-hole(s) 415 and wrapped around one or more reinforcement bars 2. Securing the reinforcement bars 2 to the ties 400 may help maintain the reinforcement bars 2 in a desired location between the first insulating layer 120A and the second insulating layer 120B while the wall material 110 is introduced therein. Each of the first and second through-holes 410 and 420 may be sized and shaped to receive a fastener 500 as shown in FIG. 5.

Referring to FIG. 5, the first end 402 of each of the ties 400 is received into the slot 330 of one of the support members 300 along the first insulating layer 120A. The first through-hole 410 of each of the ties 400 is aligned with one of the through-holes 326 of the support member 300 into which the first end 402 of the tie 400 is received. The fastener 500 is disposed within the first through-hole 410 of the tie 400 and the through-hole 326 of the support member 300 with which the through-hole 410 is aligned. The second end 404 of each of the ties 400 is received into the slot 330 of one of the support members 300 along the second insulating layer 120B. The second through-hole 420 of each of the ties 400 is aligned with one of the through-holes 326 of the support member 300 into which its second end 404 of the tie 400 is received. The fastener 500 is disposed within the second through-hole 420 of the tie 400 and the through-hole 326 of the support member 300 with which the second through-hole 420 is aligned.

Returning to FIG. 4, each of the ties 400 may have a length "L3" of about 24 cm to about 38 cm and preferably about 26 cm, about 31 cm, or about 36 cm. Each of the ties 400 may have a height "H2" of about 2.2 cm to about 2.8 cm and preferably about 2.5 cm. Each of the ties 400 may have a thickness "T4" of about 0.1 cm to about 0.3 cm and preferably about 0.2 cm.

The ties 400 may be constructed using any material known in the art for constructing ties for insulated or insulating walls including new or recycled PVC, and the like.

Reinforcement Materials and Structures

Returning to FIG. 2, optionally, the insulated wall 100 may include reinforcement materials such as reinforcement bars 2. The reinforcement bars 2 may be assembled into two-dimensional grid-like structures 10. In some embodiments, the two-dimensional grid-like structures 10 are assembled into three-dimensional grid-like structures 20. While grid-like structures 10 and 20 have been depicted in the drawings, it is apparent to those of ordinary skill in the art that the reinforcement materials, including reinforcement bars 2, may be assembled into alternate shapes and such embodiments are within the scope of the present invention.

The reinforcement materials such as reinforcement bars 2 may be used to construct structures that include voids or interstices between the reinforcement materials. In various embodiments, the reinforcement materials are used to construct an internal wall structure, such as the grid-like structures 10 and 20, that include a plurality of interstices 4 (see FIGS. 1A-1B and FIG. 2) that have a first opening 6 near the first insulating layer 120A, a second opening 8 near the second insulating layer 120B, and an unobstructed substantially linear path 7 therebetween. One or more ties 400 may be disposed along each path 7 of the interstices 4, as desired.

Corners

Figure 6:
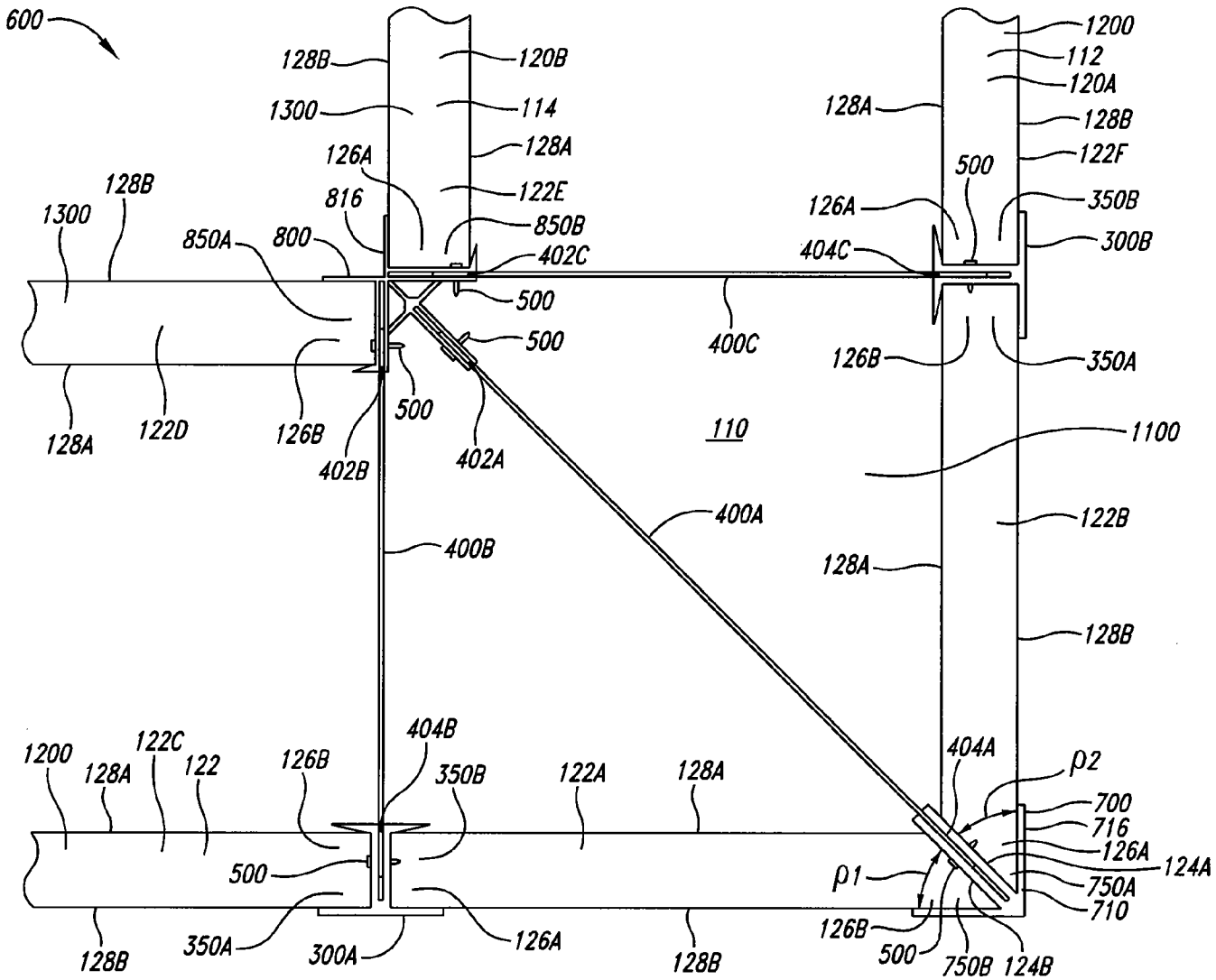
FIG. 6 is a top plan view of a corner of the insulated wall of FIG. 2.

Optionally, referring to FIGS. 2 and 6, the insulated wall 100 may include a corner 600. The corner 600 may include an outside corner support member 700 and an inside corner support member 800.

Figure 7:
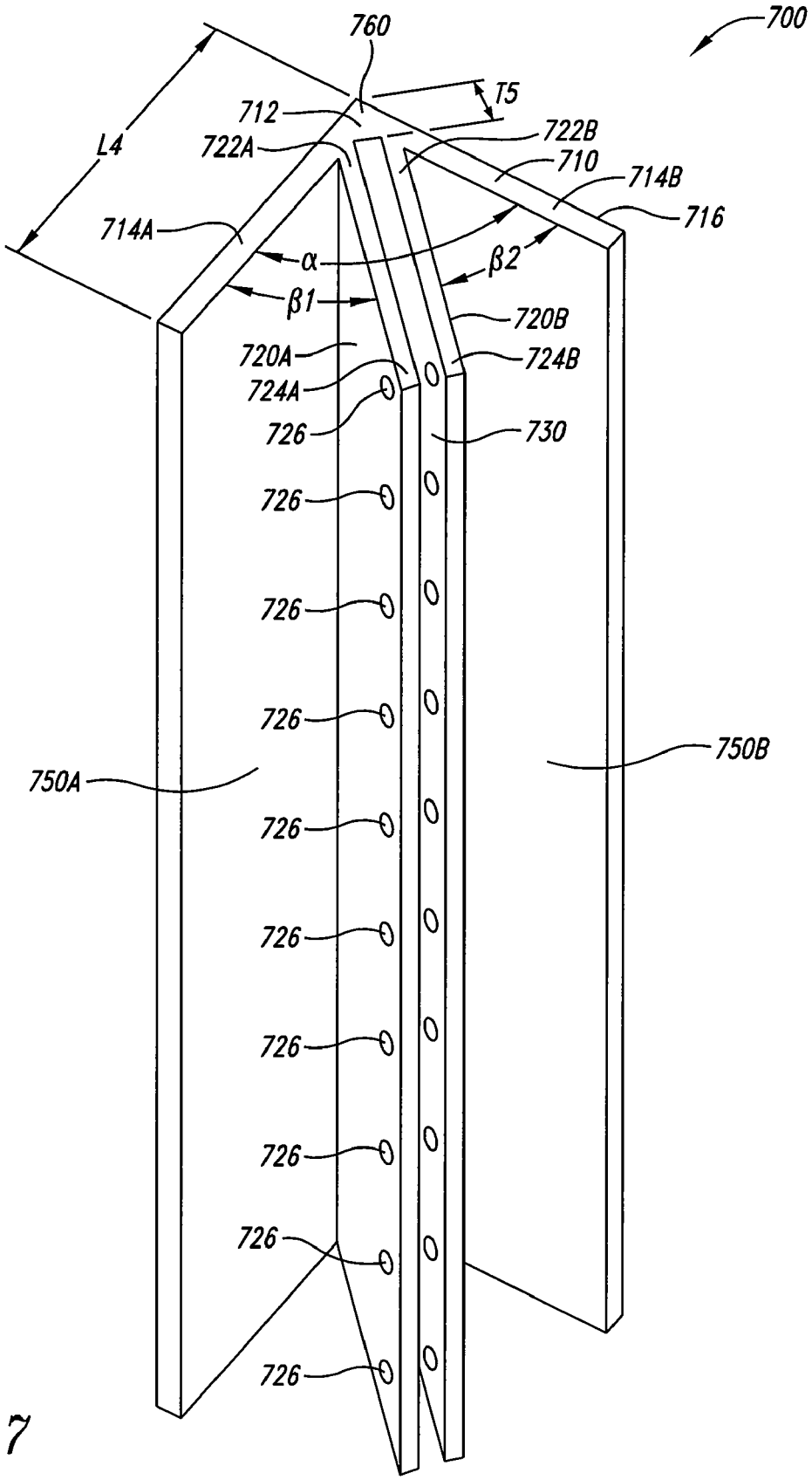
FIG. 7 is a perspective view of an inside portion of an outside corner support member of the corner of FIG. 6.

Referring to FIG. 7, the structure of the outside corner support member 700 will be described. Like the support member 300, the outside corner support member 700 includes an elongated outer member 710, shown formed by two angularly oriented contiguous flange portions 714A and 714B, oriented along the longitudinal axis of the support member 700. The outside corner support member 700 includes a pair of spaced apart central first and second walls 720A and 720B. The first and second walls 720A and 720B may be integrally formed with the outer member 710 and connected thereto by their proximal ends 722A and 722B, with the proximal end 722A of a first wall 720A connected to the portion 714A and the proximal end 722B of the second wall 720B connected to the portion 714B. The first and second walls 720A and 720B are substantially parallel to each other and spaced apart to define a slot 730 therebetween substantially similar to the slot 330 between the walls 320A and 320B of the support member 300. However, unlike the distal ends 324A and 324B of the walls 320A and 320B, distal ends 724A and 724B of the walls 720A and 720B, respectively, do not include a flange in the illustrated embodiment of FIG. 7. The walls 720A and 720B may include a plurality of corresponding pairs of through-holes 726 substantially similar to the through-holes 326 of the support member 300.

The walls 720A and 720B bifurcate the outer member 710 into its portions 714A and 714B, which intersect near the center of the slot 730. Each of the portions 714A and 714B may have a length "L4" of about 3.4 cm to about 4.2 cm and preferably about 3.8 cm.

The portions 714A and 714B may define an inside angle "a" therebetween. The outer member 710 may include a longitudinally extending outer corner portion 760 near or between the walls 720A and 720B.

An open V-shaped channel 750A is defined between the portion 714A of the outer member 710 and the wall 720A. The portion 714A of the outer member 710 may intersect with the wall 720A to form an angle "β1." In various embodiments, the angle "β1" may be equal to one-half of the angle "α." An open V-shaped channel 750B is defined between the portion 714B of the outer member 710 and the wall 720B. The portion 714B of the outer member 710 may intersect with the wall 720B to form an angle "β2." In various embodiments, the angle "β2" may be equal to one-half of the angle "α."

The outer member 710 may have a portion 712 located at or near the corner portion 760 that has an increased thickness "T5." The thickness "T5" may be about 0.3 cm to about 0.5 cm and preferably about 0.4 cm.

One of the end portions 126A and 126B of one of the insulating sheets 122 may be sized and shaped to be received within the V-shaped channels 750A and 750B. For example, referring to FIG. 6, the end portion 126B of the insulating sheet 122A is shaped or trimmed to include an angle "ρ1" approximately equal to the angle "β2" to fit snuggly into the V-shaped channel 750B. The end portion 126A of the insulating sheet 122B is similarly shaped or trimmed to include an angle "ρ2" approximately equal to the angle "β1" to fit snuggly into the V-shaped channel 750A.

The outer member 710 of the outside corner support member 700 forms an attachment portion 716 that is positioned adjacent to the outside surface 127A of the insulating layer 120A. As best shown in FIG. 6, the end portions 126A and 126B of a pair of adjacent ones of the insulating sheets 122B and 122A, respectively, are received within the channels 750A and 750B, respectively, with the outside face 128B of each toward the outer member 710 and the inside face 128A facing inward away from the outer member. Each of the outside corner support members 700 along the outside surface 127A of the insulating layer 120A may have a correspondingly positioned one of the inside corner support members 800 located along the outside surface 127B of the insulating layer 120B.

Figure 8A:
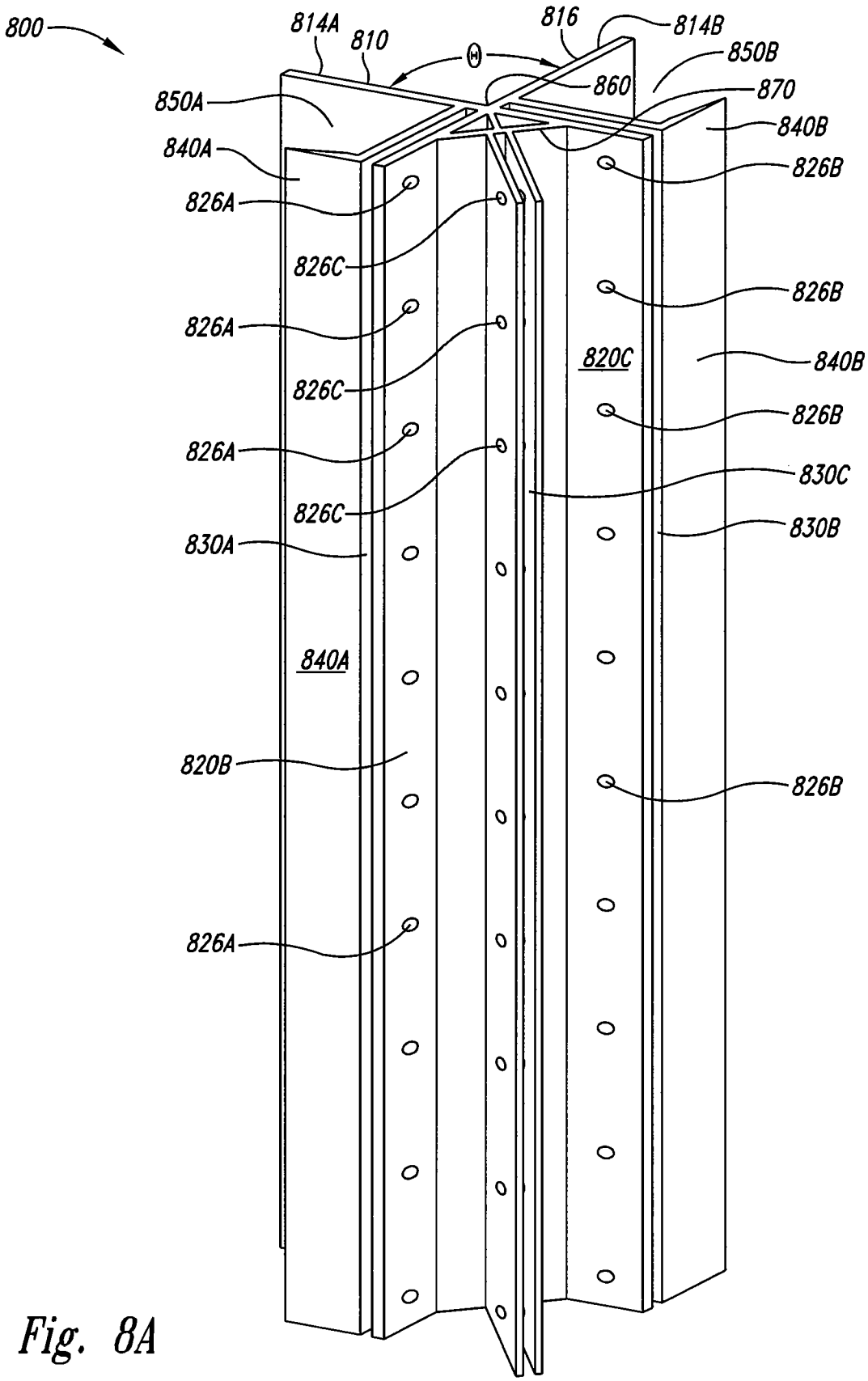
FIG. 8A is a perspective view of an inside portion of an inside corner support member of the corner of FIG. 6.
Figure 8B:
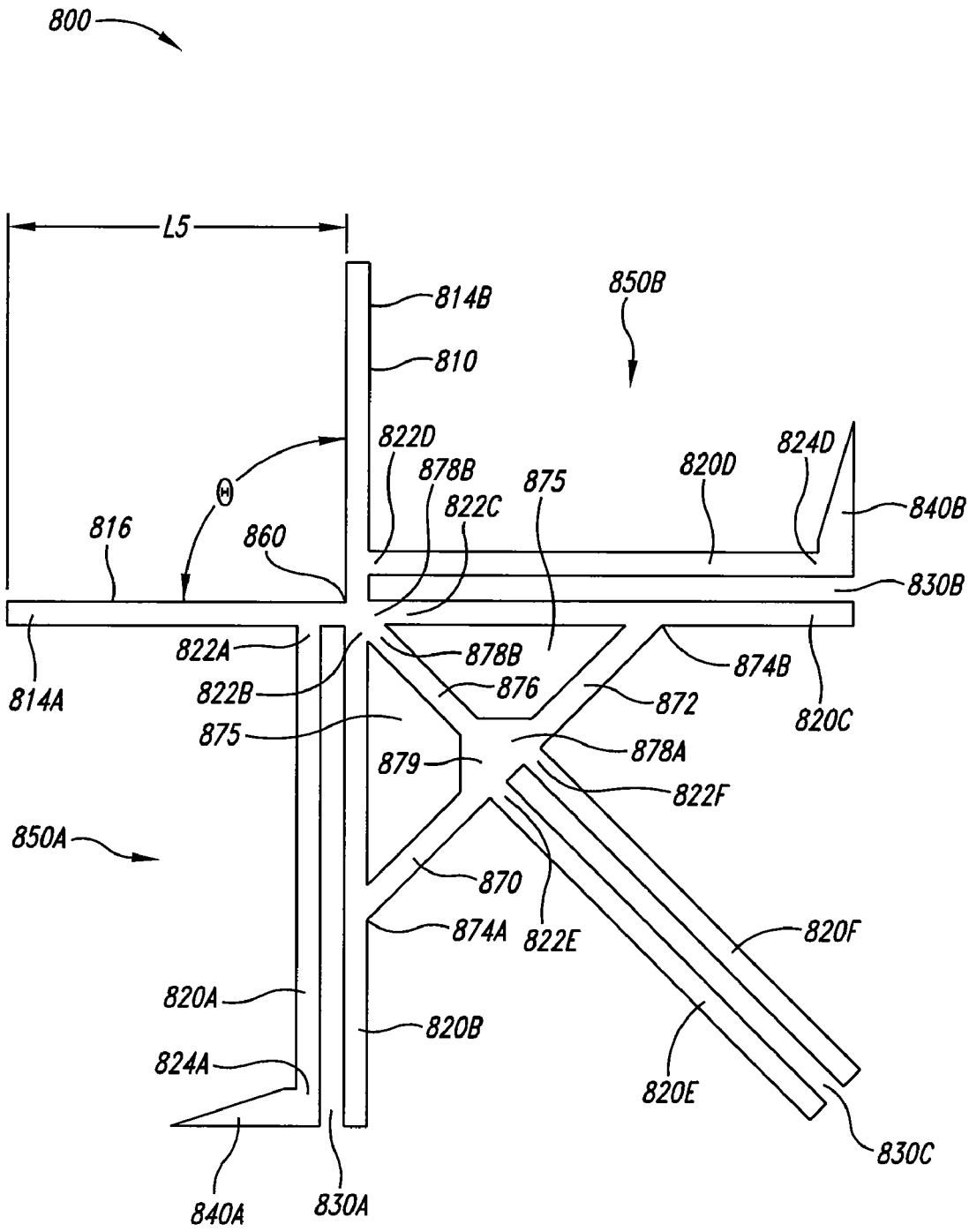
FIG. 8B is a top plan view of the inside corner support member of FIG. 8A.

Referring to FIGS. 8A and 8B, the structure of the inside corner support member 800 will be described. Like the outside corner support member 700, the inside corner support member 800 may include an outer member 810, shown formed by two angularly oriented contiguous flange portions 814A and 814B, oriented along the longitudinal axis of the inside corner support member 800. The outer member 810 forms an attachment portion 816 that is positioned adjacent to the outside surface 127B of the insulating layer 120B. The outer member 810 may have a corner portion 860 at the intersection of the portions 814A and 814B. An outside angle "θ" may be defined between the portions 814A and 814B. In various embodiments, the outside angle "θ" may be about 5° to about 170°. Each of the portions 814A and 814B may have a length "L5" of about 3.4 cm to about 4.2 cm and preferably about 3.8 cm.

Six walls 820A, 820B, 820C, 820D, 820E, and 820F may be connected to the outer member 810. Each of the walls 820A, 820B, 820C, 820D, 820E, and 820F may have substantially the same length as the walls 320A and 320B (i.e., length "L1").

The walls 820A and 820B are substantially parallel to each other and spaced apart to define a slot 830A therebetween substantially similar to the slot 330 of the support member 300. The walls 820A and 820B are connected by their proximal ends 822A and 822B, respectively, to the portion 814A of the outer member 810. In various embodiments, the proximal end 822B of the wall 820B is immediately adjacent to the corner portion 860. In particular embodiments, the wall 820B may be contiguous with the portion 814B of the outer member 810. The wall 820A may include a distal end 824A having a flange 840A substantially similar to the inner member 340B of the distal end 324B of the support member 330. Like the inner member 340B, the flange 840A may extend away from the slot 830A in a direction substantially orthogonal to the wall 820A. The walls 820A and 820B may include a plurality of corresponding pairs of through-holes 826A substantially similar to the through-holes 326 of the support member 300.

The walls 820C and 820D are substantially parallel to each other and spaced apart to define a slot 830B therebetween substantially similar to the slot 330 of the support member 300. The walls 820C and 820D are connected by their proximal ends 822C and 822D, respectively, to the portion 814B of the outer member 810. In various embodiments, the proximal end 822C of the wall 820C is immediately adjacent to the corner portion 860. In particular embodiments, the wall 820C may be contiguous with the portion 814A of the outer member 810. The wall 820D may include a distal end 824D having a flange 840B substantially similar to the inner member 340A of the distal end 324A of the support member 330. Like the inner member 340A, the flange 840B may extend away from the slot 830B in a direction substantially orthogonal to the wall 820D. The walls 820C and 820D may include a plurality of corresponding pairs of through-holes 826B substantially similar to the through-holes 326 of the support member 300.

The inside corner support member 800 may include an elongated cross member 870 having a generally T-shaped cross-sectional shape. The cross member 870 may include a substantially planar first plate 872 having a first end portion 874A and a second end portion 874B. The first plate 872 may be connected to the wall 820B along the first end portion 874A and to the wall 820C along the second end portion 874B. In embodiments wherein the locations of attachment between the first end portion 874A to the wall 820B and the second end portion 874B to the wall 820C are spaced from the corner portion 860, a gap 875 may be defined between the first plate 872 and the wall 820B and between the first plate 872 and the wall 820C. The cross member 870 may include a second plate 876 connected between the first plate 872 and the corner portion 860 of the outer member 810. In one embodiment, the second plate 876 includes first and second end portions 878A and 878B, respectively. The first end portion 878A of the second plate 876 may be connected to the first plate 872 and the second end portion 878B to the corner portion 860 of the outer member 810. The first end portion 878A of the second plate 876 may include a portion 879 having a generally triangular cross-sectional shape located near the intersection of the first end portion 878A and the first plate 872.

The walls 820E and 820F are substantially parallel to each other and spaced apart to define a slot 830C therebetween substantially similar to the slot 730 of the outside corner support member 700. The walls 820E and 820F are connected by their proximal ends 822E and 822F, respectively, to the first plate 872 of the cross member 870 at a location approximately midway between the first and second end portions 874A and 874B. The walls 820E and 820F may extend away from the first plate 872 in a direction substantially orthogonal to the first plate 872. In this manner, the slot 830C may be adjacent to the location along the first plate 872 approximately midway between its first and second end portions 874A and 874B. In various embodiments, the walls 820E and 820F may bisect the space between the walls 820B and 820C into two equally sized spaces. The walls 820E and 820F may include a plurality of corresponding pairs of through-holes 826C substantially similar to the through-holes 726 of the outside corner support member 700.

An open channel 850A substantially similar to the open channel 350B is defined between the portion 814A of the outer member 810, the wall 820A, and the flange 840A. An open channel 850B substantially similar to the open channel 350A is defined between the portion 814B of the outer member 310, the wall 820B, and the flange 840B. As best shown in FIG. 6, the end portions 126B and 126A of a pair of adjacent ones of the insulating sheets 122D and 122E, respectively, are received within the channels 850A and 850B, respectively, with the outside face 128B of each toward the outer member 810 and the inside face 128A facing inward away from the outer member and toward the flanges 840A and 840B, respectively.

Returning to FIG. 6, the corner 600 may include the outside corner support member 700, the inside corner support member 800, a first support member 300A, a second support member 300B, and at least two insulating sheets 122A and 122B. The outside corner support member 700 is positioned diagonally across the corner 600 from the inside corner support member 800. A plurality of ties 400A extend from the slot 830C (see FIGS. 8A-8B) of the inside corner support member 800 through the wall material 110 to the slot 730 of the outside corner support member 700. A plurality of fasteners 500 are used to retain the first end 402A of the ties 400A within the slot 830C and a plurality of fasteners 500 are used to retain the second end 404A of the ties 400A within the slot 730. Each of the fasteners 500 retaining the first end 402A of the ties 400A within the slot 830C may be disposed within one of the corresponding pairs of through-holes 826C and the first through-hole 410 of one of the ties 400A. Each of the fasteners 500 retaining the second end 404A of the ties 400A within the slot 730 may be disposed within one of the corresponding pairs of through-holes 726 and the second through-hole 420 of one of the ties 400A.

The walls 320A and 320B of support member 300A are positioned across from the walls 820A and 820B of the inside corner support member 800, in about the same plane. A plurality of ties 400B extend from the slot 830A of the inside corner support member 800 through the wall material 110 to the slot 330 of the outside corner support member 300A. A plurality of fasteners 500 are used to retain the first end 402B of the ties 400B within the slot 830A and a plurality of fasteners 500 are used to retain the second end 404B of the ties 400B within the slot 330 of support member 300A. Each of the fasteners 500 retaining the first end 402B of the ties 400B within the slot 830A may be disposed within one of the corresponding pairs of through-holes 826A and the first through-hole 410 of one of the ties 400B. Each of the fasteners 500 retaining the second end 404B of the ties 400B within the slot 330 may be disposed within one of the corresponding pairs of through-holes 326 and the second through-hole 420 of one of the ties 400B.

The walls 320A and 320B of support member 300B are positioned across from the walls 820C and 820D of the inside corner support member 800, in about the same plane. A plurality of ties 400C extend from the slot 830B of the inside corner support member 800 through the wall material 110 to the slot 330 of the outside corner support member 300B. A plurality of fasteners 500 are used to retain the first end 402C of the ties 400C within the slot 830B and a plurality of fasteners 500 are used to retain the second end 404C of the ties 400C within the slot 330 of support member 300B. Each of the fasteners 500 retaining the first end 402C of the ties 400C within the slot 830B may be disposed within one of the corresponding pairs of through-holes 826B and the first through-hole 410 of one of the ties 400C. Each of the fasteners 500 retaining the second end 404C of the ties 400C within the slot 330 may be disposed within one of the corresponding pairs of through-holes 326 and the second through-hole 420 of one of the ties 400C.

The end portion 126A of the insulating sheet 122A may be disposed within the channel 350B of the support member 300A and the end portion 126B of the insulating sheet 122A may be disposed within the channel 750B of the outside corner support member 700. The end portion 126A of the insulating sheet 122B may be disposed within the channel 350A of the support member 300B and the end portion 126B of the insulating sheet 122B may be disposed within the channel 750A of the outside corner support member 700.

The corner 600 may include additional insulating sheets, such as insulating sheets 122C, 122D, 122E, and 122F. For example, the portion 126B of the insulating sheet 122C may be disposed within the channel 350A of the support member 300A. The portion 126A of the insulating sheet 122F may be disposed within the channel 350B of the support member 300B. The portion 126B of the insulating sheet 122D may be disposed within the channel 850A of the inside corner support member 800. The portion 126A of the insulating sheet 122E may be disposed within the channel 850B of the inside corner support member 800.

The portion 126B of the insulating sheet 122A may be configured to be received inside the channel 750B and the portion 126A of the insulating sheet 122B may be configured to be received inside the channel 750A. In various embodiments, the angle "ρ1" (defined between the outside face 128B and the second end wall 124B of the insulating sheet 122A) may be determined by the angle "β2" formed between the portion 714B of the outer member 710 and the wall 720B. In particular embodiments, the angle "ρ1" may approximate the angle "β2." In various embodiments, the angle "ρ2" (defined between the outside face 128B and the first end wall 124A of the insulating sheet 122B) may be determined by the angle "β1" formed between the portion 714A of the outer member 710 and the wall 720A. In particular embodiments, the angle "ρ2" may approximate the angle "β1."

While corner 600 depicted in the drawings has a substantially 90° inside angle, those of ordinary skill in the art recognize that the corner 600 may include corners having various inside angles including acute and obtuse angles and the present invention is not limited by the angle selected. In particular embodiments, the inside angle of the corner 600 is about 5° to about 170°. In various embodiments, the outside angle of the corner 600 may be determined by the angle "α" between the portions 714A and 714B of the outside corner support member 700. In various embodiments, the inside angle of the corner 600 may be determined by the angle "θ" between the portions 814A and 814B of the inside corner support member 800. As is apparent to those of ordinary skill, the angle of the corner 600 may be modified by minor adjustments to various components of the insulated wall 100 and such embodiments are within the scope of the invention.

Each of the attachment portions 316, 716, and 816 of the support members 300, outside corner support members 700, and inside corner support members 800, respectively, included in the insulated wall 100 are disposed along one of the outside surfaces 127A and 127B of the insulating layers 120A and 120B. The attachment portions 316, 716, and 816 provide a substrate to which wall components (not shown), such as drywall, paneling, siding, sheeting, stucco, parging, Drivite, brick, stone veneers, and the like may be attached.

The support members 300, outside corner support members 700, and inside corner support members 800 may be constructed using any material known in the art for constructing support members for insulated or insulating walls including extruded PVC, galvanized metal, recycled plastic, and the like.

Wall Forming System 1000

Figure 9:
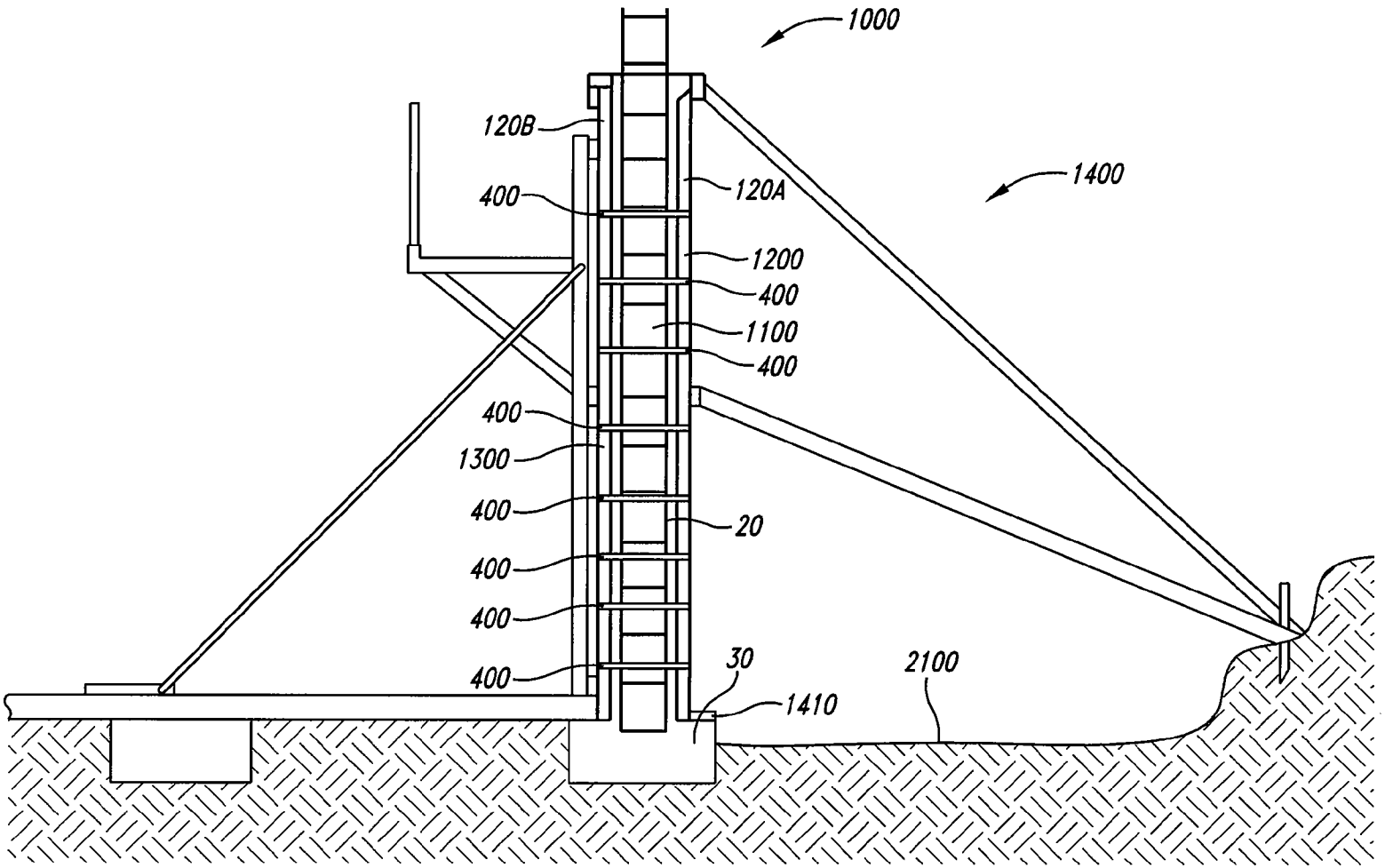
FIG. 9 is a cross-sectional view of a wall forming system used to construct the insulated wall of FIG. 2.

The insulated wall 100 may be constructed using the wall forming system 1000 shown in FIG. 9. As will become apparent, many of the components of the wall forming system 1000 are incorporated into and become part of the finished insulated wall 100. Consequently, many of the drawings used to describe the finished insulated wall 100 will also be used to describe the wall forming system 1000.

Referring to FIGS. 2 and 9, the wall forming system 1000 includes a first sidewall 1200 and a second sidewall 1300. In the finished insulated wall 100, the first sidewall 1200 may form the first insulating layer 120A and the second sidewall 1300 may form the second insulating layer 120B. Consequently, the first sidewall 1200 may include all of the components assembled in the manner discussed above with respect to the first insulating layer 120A. Similarly, the second sidewall 1300 may include all of the components assembled in the manner discussed above with respect to the second insulating layer 120B. Specifically, each of the first and second sidewalls 1200 and 1300 may include a plurality of support members 300 and a plurality of insulating sheets 122. Optionally, the first and second sidewalls 1200 and 1300 may include one or more outside corner support members 700 and/or one or more inside corner support members 800.

The first wall 1200 may be substantially parallel to and spaced from the second wall 1300. Both the first wall 1200 and the second wall 1300 may rest upon the footing 30. A wall cavity 1100 is defined between the first sidewall 1200 and the second sidewall 1300. The footing 30 may provide a bottom for the cavity 1100. To form the finished insulated wall 100, the wall material 110 is poured, sprayed, or otherwise inserted into the cavity 1100.

The first and second sidewalls 1200 and 1300 are connected across the cavity 1100 by the plurality of ties 400. Each of the support members 300 within a portion of the support members 300 of the first sidewall 1200 have a corresponding support member 300 located directly across the cavity 1100. As described above, a plurality of ties 400 may extend between the support members 300 of the first wall 1200 and the support members 300 of the second wall 1300.

While the through-holes 410, 420, 326, 726, 826A, 826B, and 826C depicted in the drawings have a generally circular cross-sectional shape, it is apparent to those of ordinary skill that the through-holes may have alternate cross-sectional shapes such as square, oval, rectangular, triangular, arbitrary, and the like. Those of ordinary skill will also appreciate that one or both of the through-holes 410 and 420 may be wider along a direction defined between the first end 402 and second end 404. In this manner, the fastener 500 may slide within one or both of the through-holes 410 and 420 to allow for variances in the distance between the support members 300 of the first and second sidewalls 1200 and 1300. In various embodiments, the through-holes 326, 726, 826A, 826B, and/or 826C may be wider along a direction substantially orthogonal to the longitudinal axis of the support member. In this manner, the fastener 500 may slide within the through-holes 326, 726, 826A, 826B, and/or 826C to allow for variances in the distance between the support members 300, outside corner support members 700, and/or inside corner support members 800 of the first and second sidewalls 1200 and 1300.

Optionally, reinforcement materials such as reinforcement bars 2 may be disposed within the cavity 1100. The reinforcement bars 2 may be assembled into two-dimensional grid-like structures 10 or three-dimensional grid-like structures 20 including voids or interstices 4 (see FIGS. 1A-1B and FIG. 2) between the reinforcement materials. The first opening 6 of the interstices 4 may be near the first sidewall 1200, the second opening 8 may be near the second sidewall 1300, and the unobstructed substantially linear path 7 therebetween may extend between the first and second sidewalls 1200 and 1300. One or more of the ties 400 used to connect the first and second sidewalls 1200 and 1300 may be disposed along selected ones of the paths 7 of the interstices 4.

Additional external support members 1400 known in the art may be connected between one or both of the first and second sidewalls 1200 and 1300 and the ground 2100 or other anchoring structure(s). In various embodiments, the external support members 1400 may be attached to the attachment portions 316 of the support members 300, the attachment portions 716 of the outside corner support member 700, and/or the attachment portions 816 of the inside corner support member 800. The external support members 1400 may include one or more substantially horizontally extending members 1410 (see also FIG. 2) disposed along the footing 30 near the location where the footing 30 intersects with the first and second sidewalls 1200 and 1300. The horizontally extending members 1410 may help prevent the outwardly directed forces exerted by the wall material 110 on the first and second sidewalls 1200 and 1300 from outwardly displacing a lower portion of first and second sidewalls 1200 and 1300. Other external support members 1400, such as scaffolding, bracing members, and the like, may be anchored to the horizontally extending members 1410. Each of the horizontally extending members 1410 may include any suitable member known in the art including an L-shaped member constructed using plastic or galvanized metal. The external support members 1400 may be removed after the liquid wall material 110 has solidified.

Method of Constructing Wall Forming System 1000

Generally speaking, before the wall forming system 1000 is constructed, the footing(s) 30 has/have been constructed. If the insulated wall 100 is to include reinforcement materials, such as the two-dimensional grid-like structures 10 or three-dimensional grid-like structures 20, these structures may be constructed and placed on the footing 30 before the wall forming system 1000 is constructed. In other words, the wall forming system 1000 may be constructed around the two-dimensional grid-like structures 10 or three-dimensional grid-like structures 20.

Because the insulated wall 100 may include one or more linear sections 1500 and one or more corners 600, an exemplary method 2000 of assembling the various components of the wall forming system 1000 to construct the linear wall section 1500 will be treated first followed by a description of an exemplary method 2500 of assembling the various components of the wall forming system 1000 to construct the corner 600. As is apparent to those of ordinary skill, the linear wall section 1500 and corners 600 described herein may be combined in any manner to form various embodiments of the insulated wall 100.

Method of Constructing Linear Wall Section 1500

Figure 10:
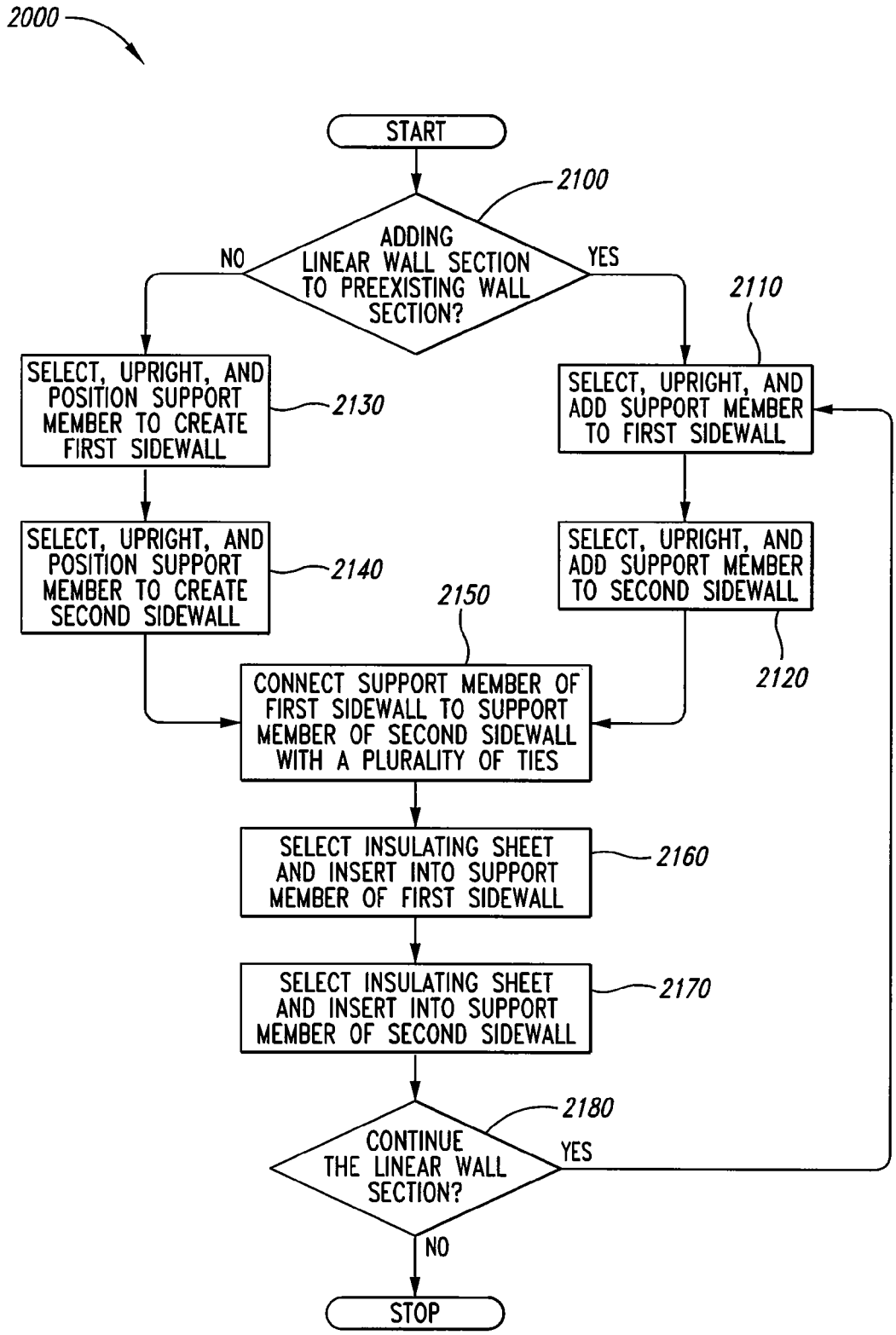
FIG. 10 is a block diagram illustrating a method of constructing a linear wall section of the wall forming system of FIG. 9.

Referring to FIGS. 10 and 11, the method 2000 of constructing a linear wall section 1500 starts in a decision block 2100 wherein the decision is made to add the linear wall section 1500 to a preexisting section 1600 or construct a new freestanding linear wall section.

If the linear wall section 1500 is being added to a preexisting section 1600 of the wall forming system 1000, the first sidewall 1200 terminates in an end portion 126B of a first insulating sheet 122G and the second sidewall 1300 terminates in a end portion 126B of a second insulating sheet 122H. In a block 2110, the support member 300C is selected, uprighted, and the channel 350B of the support member 300C is slid (in the direction indicated by arrow "A") onto the end portion 126B of the first insulating sheet 122G. In a next block 2120, the support member 300D is selected, uprighted, positioned directly across the cavity 1100 from the support member 300C, and the channel 350A of the support member 300D is slid (in the direction indicated by arrow "A") onto the end portion 126B of the second insulating sheet 122H.

On the other hand, if the linear wall section 1500 is not being added to a preexisting section of the wall forming system 1000, in a block 2130, the support member 300C is selected, uprighted, and positioned in a desired location to create the first sidewall 1200. Next, in a block 2140, the support member 300D is selected, uprighted, and positioned directly across the cavity 1100 from the support member 300C to create the second sidewall 1300.

In a block 2150, a plurality of ties 400 are fastened between the support member 300C and the support member 300D. Each of the ties 400 are fastened by their first end 402 to the support member 300C and by their second end 404 to the support member 300D. The first end 402 of each of the ties 400 is inserted into the slot 330 of the support member 300C. The through-hole 410 is aligned with one of the through-holes 326 through the walls 320A and 320B and the fastener 500 is inserted into the aligned through-holes 326 and 410. Next, the second end 404 of each of the ties 400 is inserted into the slot 330 of the support member 300D. The through-hole 410 is aligned with one of the through-holes 326 through the walls 320A and 320B and the fastener 500 is inserted into the aligned through-holes 326 and 410.

In a next block 2160, the end portion 126A of the insulating sheet 122J is inserted into the channel 350A of the support member 300C. In a next block 2170, the end portion 126A of the insulating sheet 122K is inserted into the channel 350B of the support member 300D. At this point, a linear section of the first and second sidewalls 1200 and 1300 has been constructed.

In a decision block 2180, the decision is made to continue the sidewalls 1200 and 1300 in a linear fashion. If it is decided to continue the sidewalls 1200 and 1300 in a linear fashion, the method 2000 returns to the block 2100. Otherwise, the method 2000 terminates.

While method 2000 has been described as constructing the linear wall section 1500 of the wall forming system 1000 along the direction indicated by the arrows "A", those of ordinary skill appreciate that the linear wall section 1500 of the wall forming system 1000 may be constructed along a direction opposite that indicated by the arrows "A."

Method of Constructing Corner 600

Figure 12A:
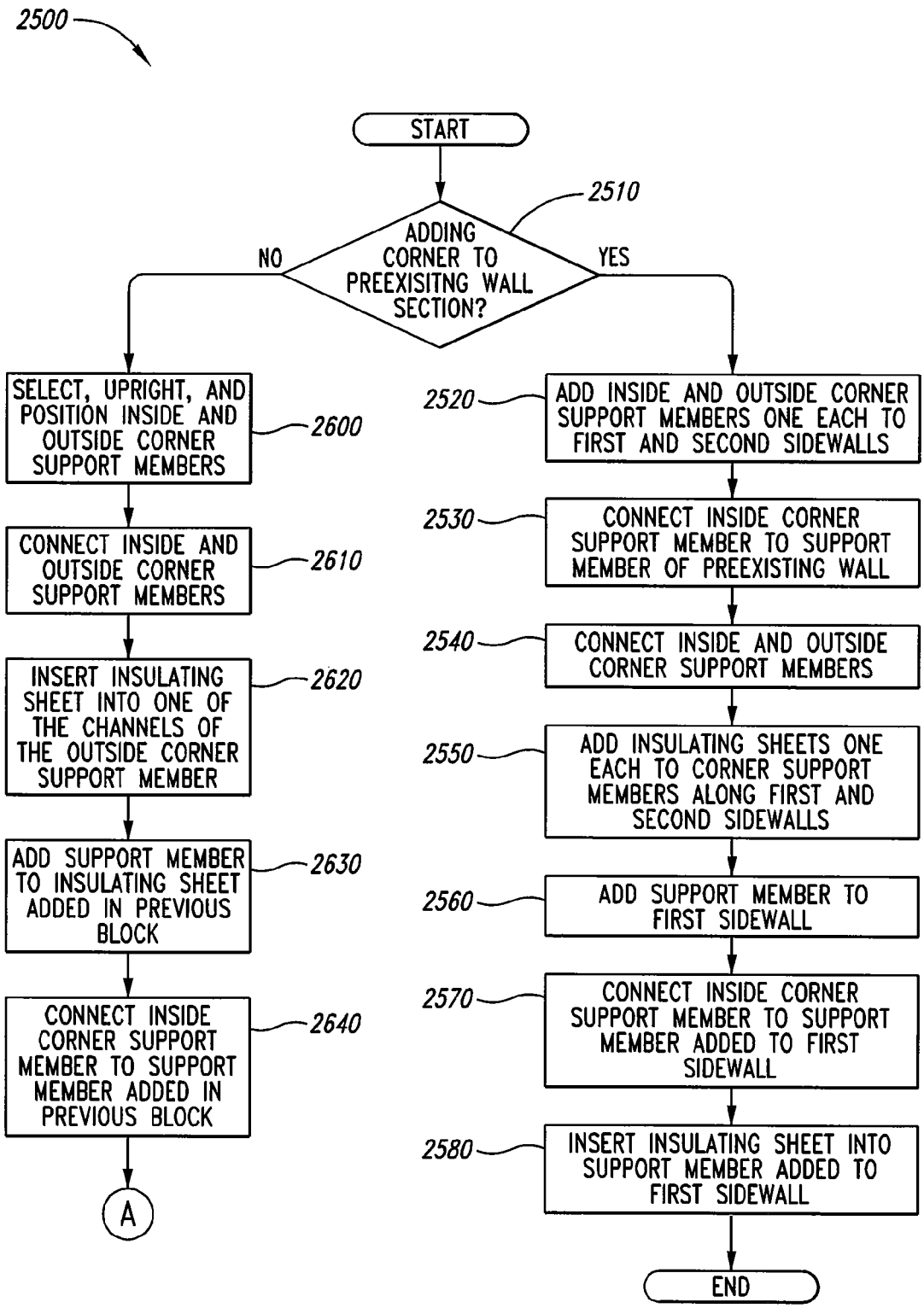
FIG. 12A is a block diagram illustrating a first portion of a method of constructing a corner of the wall forming system of FIG. 9.
Figure 12B:
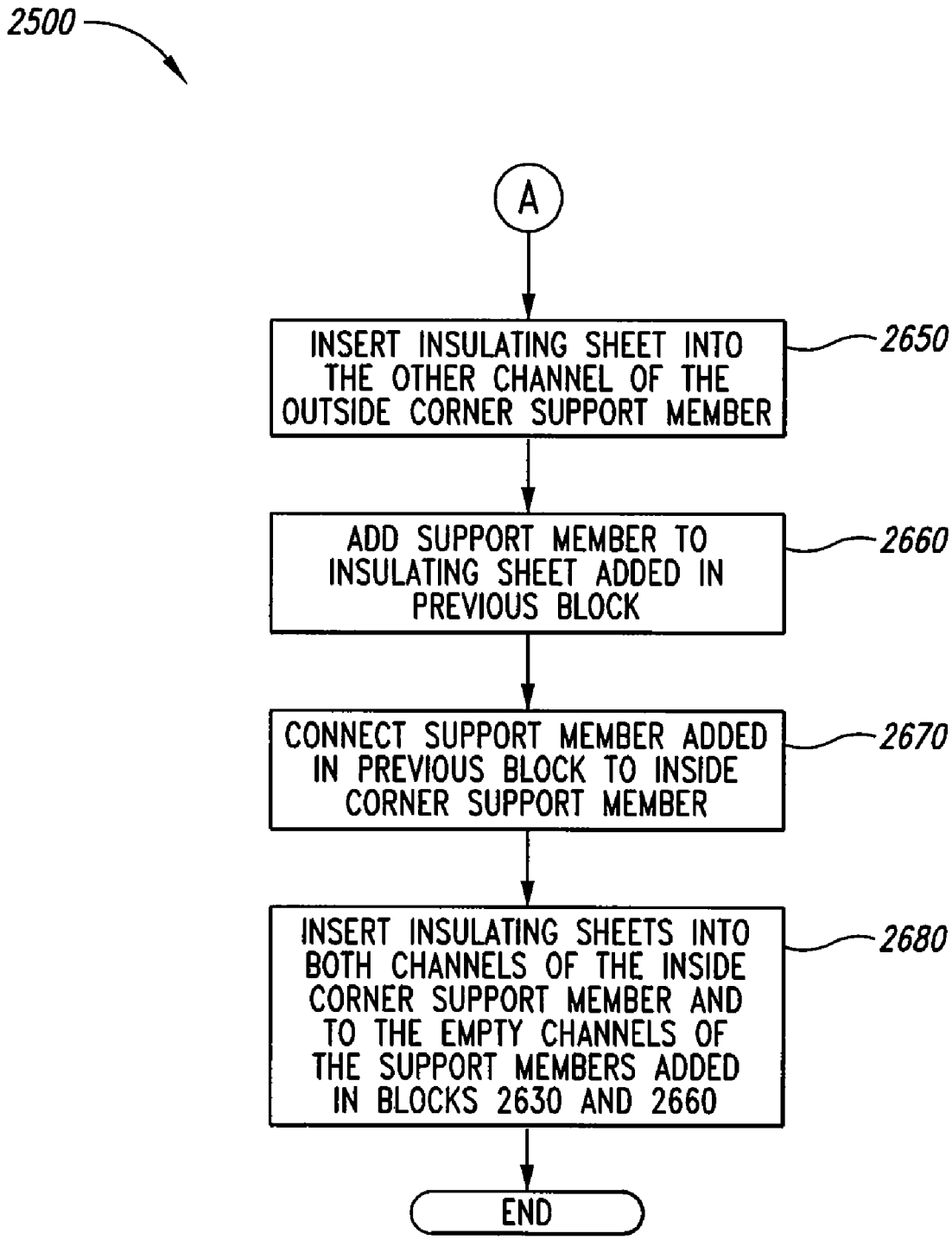
FIG. 12B is a block diagram illustrating a second portion of the method of constructing the corner of the wall forming system of FIG. 9.

Referring to FIGS. 6, 12A, and 12B, the method 2500 of constructing a corner 600 starts in a decision block 2510 wherein the decision is made to add the corner 600 to a preexisting section 1600 or construct a new freestanding corner 600.

If the corner 600 is being added to a preexisting section of the wall forming system 1000, in a block 2520, the method 2500 includes selecting, uprighting, and adding the outside corner support member 700 and inside corner support member 800 to the end portions 126 of the insulating sheets 122 terminating the preexisting section 1600. However, two alternative configurations are possible for the insulating sheets 122 terminating the preexisting section 1600. One, the first sidewall 1200 terminates in the end portion 126A of the first insulating sheet 122B and the second sidewall 1300 terminates in an end portion 126A of a second insulating sheet 122E. Two, the first sidewall 1200 terminates in the end portion 126B of the first insulating sheet 122A, and the second sidewall 1300 terminates in an end portion 126B of a second insulating sheet 122D. The first alternative is treated first and a description of the second alternative follows.

In the block 2520, the outside corner support member 700 is selected, uprighted, and the channel 750A of the outside corner support member 700 is slid onto the end portion 126A of the first insulating sheet 122B. The inside corner support member 800 is selected, uprighted, and positioned diagonally across the cavity 1100 from the outside corner support member 700, and the channel 850B of the inside corner support member 800 is slid onto the end portion 126A of the second insulating sheet 122E.

Next In the block 2530, the inside corner support member 800 is connected to the support member 300B disposed along the end portion 126B of a first insulating sheet 122B. A plurality of ties 400C are fastened between the inside corner support member 800 and the support member 300B. Each of the ties 400C are fastened by their first end 402C to the inside corner support member 800 and by their second end 404C to the support member 300B. The first end 402C of each of the ties 400C is inserted into the slot 830B of the inside corner support member 800. The through-hole 410 is aligned with one of the through-holes 826B through the walls 820C and 820D and the fastener 500 is inserted into the aligned through-holes 826B and 410. Next, the second end 404C of each of the ties 400C is inserted into the slot 330 of the support member 300B. The through-hole 410 is aligned with one of the through-holes 326 through the walls 320A and 320B and the fastener 500 is inserted into the aligned through-holes 326 and 410.

In a block 2540, a plurality of ties 400A are fastened between the outside corner support member 700 and the inside corner support member 800. Each of the ties 400A are fastened by their first end 402A to the inside corner support member 800 and by their second end 404A to the outside corner support member 700. The first end 402A of each of the ties 400A is inserted into the slot 830C of the inside corner support member 800. The through-hole 410 is aligned with one of the through-holes 826C through the walls 820E and 820F and the fastener 500 is inserted into the aligned through-holes 826C and 410. Next, the second end 404A of each of the ties 400A is inserted into the slot 730 of the outside corner support member 700. The through-hole 410 is aligned with one of the through-holes 726 through the walls 720A and 720B and the fastener 500 is inserted into the aligned through-holes 726 and 410.

Next, in a block 2550, the portion 126B of the insulating sheet 122A is inserted into the channel 750B of the outside corner support member 700 and the end portion 126B of the first insulating sheet 122D is inserted into the channel 850A of the inside corner support member 800.

Next, in a block 2560, the support member 300A is selected, uprighted, and positioned directly across the cavity 1100 from the walls 820A and 820B of the inside corner support member 800, and the channel 350B of the support member 300A is slid onto the portion 126A of the insulating sheet 122A.

Next In the block 2570, the inside corner support member 800 is connected to the support member 300A disposed along the end portion 126A of a first insulating sheet 122A. A plurality of ties 400B are fastened between the inside corner support member 800 and the support member 300A. Each of the ties 400B are fastened by their first end 402B to the inside corner support member 800 and by their second end 404B to the support member 300A. The first end 402B of each of the ties 400B is inserted into the slot 830A of the inside corner support member 800. The through-hole 410 is aligned with one of the through-holes 826A through the walls 820A and 820B and the fastener 500 is inserted into the aligned through-holes 826A and 410. Next, the second end 404B of each of the ties 400B is inserted into the slot 330 of the support member 300A. The through-hole 410 is aligned with one of the through-holes 326 through the walls 320A and 320B and the fastener 500 is inserted into the aligned through-holes 326 and 410. In a block 2580, the end portion 126B of the insulating sheet 122C is inserted into the channel 350A of the support member 300A.

Turning now to the second alternative, i.e., the first sidewall 1200 terminates in the portion 126B of the first insulating sheet 122A, and the second sidewall 1300 terminates in an end portion 126B of a second insulating sheet 122D.

In the block 2520, the outside corner support member 700 is selected, uprighted, and the channel 750B of the outside corner support member 700 is slid onto the end portion 126B of the first insulating sheet 122A, the inside corner support member 800 is selected, uprighted, and positioned diagonally across the cavity 1100 from the outside corner support member 700, and the channel 850A of the inside corner support member 800 is slid onto the end portion 126B of the second insulating sheet 122D.

In the block 2530, the inside corner support member 800 is connected to the support member 300A disposed along the end portion 126A of a first insulating sheet 122A. A plurality of ties 400B are fastened between the inside corner support member 800 and the support member 300A. Each of the ties 400B are fastened by their first end 402B to the inside corner support member 800 and by their second end 404B to the support member 300A. The first end 402B of each of the ties 400B is inserted into the slot 830A of the inside corner support member 800. The through-hole 410 is aligned with one of the through-holes 826A through the walls 820A and 820B and the fastener 500 is inserted into the aligned through-holes 826A and 410. Next, the second end 404B of each of the ties 400B is inserted into the slot 330 of the support member 300A. The through-hole 410 is aligned with one of the through-holes 326 through the walls 320A and 320B and the fastener 500 is inserted into the aligned through-holes 326 and 410.

In the block 2540, a plurality of ties 400A are fastened between the outside corner support member 700 and the inside corner support member 800. Each of the ties 400A are fastened by their first end 402A to the inside corner support member 800 and by their second end 404A to the outside corner support member 700. The first end 402A of each of the ties 400A is inserted into the slot 830C of the inside corner support member 800. The through-hole 410 is aligned with one of the through-holes 826C through the walls 820E and 820F and the fastener 500 is inserted into the aligned through-holes 826C and 410. Next, the second end 404A of each of the ties 400A is inserted into the slot 730 of the outside corner support member 700. The through-hole 410 is aligned with one of the through-holes 726 through the walls 720A and 720B and the fastener 500 is inserted into the aligned through-holes 726 and 410.

Next, in the block 2550, the end portion 126A of the first insulating sheet 122B is inserted into the channel 750A of the outside corner support member 700 and the end portion 126A of the first insulating sheet 122E is inserted into the channel 850B of the inside corner support member 800.

Next, in the block 2560, the support member 300B is selected, uprighted, and positioned directly across the cavity 1100 from the walls 820C and 820D of the inside corner support member 800, and the channel 350A of the support member 300B is slid onto the end portion 126B of the insulating sheet 122B.

Next in the block 2570, the inside corner support member 800 is connected to the support member 300B disposed along the end portion 126B of the insulating sheet 122B. A plurality of ties 400C are fastened between the inside corner support member 800 and the support member 300B. Each of the ties 400C are fastened by their first end 402C to the inside corner support member 800 and by their second end 404C to the support member 300B. The first end 402C of each of the ties 400C is inserted into the slot 830B of the inside corner support member 800. The through-hole 410 is aligned with one of the through-holes 826B through the walls 820C and 820D and the fastener 500 is inserted into the aligned through-holes 826B and 410. Next, the second end 404C of each of the ties 400C is inserted into the slot 330 of the support member 300B. The through-hole 410 is aligned with one of the through-holes 326 through the walls 320A and 320B and the fastener 500 is inserted into the aligned through-holes 326 and 410. In the block 2580, the end portion 126A of the insulating sheet 122F is inserted into the channel 350B of the support member 300B.

On the other hand, if the corner 600 is not being added to a preexisting section of the wall forming system 1000, in a block 2600, the outside corner support member 700 is selected, uprighted, and positioned in a desired location and the inside corner support member 800 is selected, uprighted, and positioned diagonally across the cavity 1100 from the outside corner support member 700.

In a block 2610, a plurality of ties 400A are fastened between the outside corner support member 700 and the inside corner support member 800. Each of the ties 400A are fastened by their first end 402A to the inside corner support member 800 and by their second end 404A to the outside corner support member 700. The first end 402A of each of the ties 400A is inserted into the slot 830C of the inside corner support member 800. The through-hole 410 is aligned with one of the through-holes 826C through the walls 820E and 820F and the fastener 500 is inserted into the aligned through-holes 826C and 410. Next, the second end 404A of each of the ties 400A is inserted into the slot 730 of the outside corner support member 700. The through-hole 410 is aligned with one of the through-holes 726 through the walls 720A and 720B and the fastener 500 is inserted into the aligned through-holes 726 and 410.

Next, in a block 2620, the end portion 126B of the first insulating sheet 122A is inserted into the channel 750B of the outside corner support member 700 and the end portion 126B of the first insulating sheet 122D is inserted into the channel 850A of the inside corner support member 800.

Next in a block 2630, the support member 300A is selected, uprighted, and positioned directly across the cavity 1100 from the walls 820A and 820B of the inside corner support member 800, and the channel 350B of the support member 300A is slid onto the end portion 126A of the insulating sheet 122A.

Next in a block 2640, the inside corner support member 800 is connected to the support member 300A disposed along the end portion 126A of a first insulating sheet 122A. A plurality of ties 400B are fastened between the inside corner support member 800 and the support member 300A. Each of the ties 400B are fastened by their first end 402B to the inside corner support member 800 and by their second end 404B to the support member 300A. The first end 402B of each of the ties 400B is inserted into the slot 830A of the inside corner support member 800. The through-hole 410 is aligned with one of the through-holes 826A through the walls 820A and 820B and the fastener 500 is inserted into the aligned through-holes 826A and 410. Next, the second end 404B of each of the ties 400B is inserted into the slot 330 of the support member 300A. The through-hole 410 is aligned with one of the through-holes 326 through the walls 320A and 320B and the fastener 500 is inserted into the aligned through-holes 326 and 410.

Next in a block 2650, the end portion 126A of the first insulating sheet 122B is inserted into the channel 750A of the outside corner support member 700 and the end portion 126A of the first insulating sheet 122E is inserted into the channel 850B of the inside corner support member 800.

Next, in a block 2660, the support member 300B is selected, uprighted, and positioned directly across the cavity 1100 from the walls 820C and 820D of the inside corner support member 800, and the channel 350A of the support member 300B is slid onto the end portion 126B of the insulating sheet 122B.

Next in a block 2670, the inside corner support member 800 is connected to the support member 300B disposed along the end portion 126B of the insulating sheet 122B. A plurality of ties 400C are fastened between the inside corner support member 800 and the support member 300B. Each of the ties 400C are fastened by their first end 402C to the inside corner support member 800 and by their second end 404 to the support member 300B. The first end 402C of each of the ties 400C is inserted into the slot 830B of the inside corner support member 800. The through-hole 410 is aligned with one of the through-holes 826B through the walls 820C and 820D and the fastener 500 is inserted into the aligned through-holes 826B and 410. Next, the second end 404C of each of the ties 400C is inserted into the slot 330 of the support member 300B. The through-hole 410 is aligned with one of the through-holes 326 through the walls 320A and 320B and the fastener 500 is inserted into the aligned through-holes 326 and 410.

In a block 2680, the end portion 126A of the insulating sheet 122E is inserted into the channel 850B of the inside corner support member 800 and the end portion 126B of the insulating sheet 122D is inserted into the channel 850A of the inside corner support member 800. In the block 2680, the portion 126B of the insulating sheet 122C is inserted into the channel 350A of the support member 300A and the portion 126A of the insulating sheet 122F is inserted into the channel 350B of the support member 300B.

Alternate Embodiment of the Insulated Wall

Figure 13A:
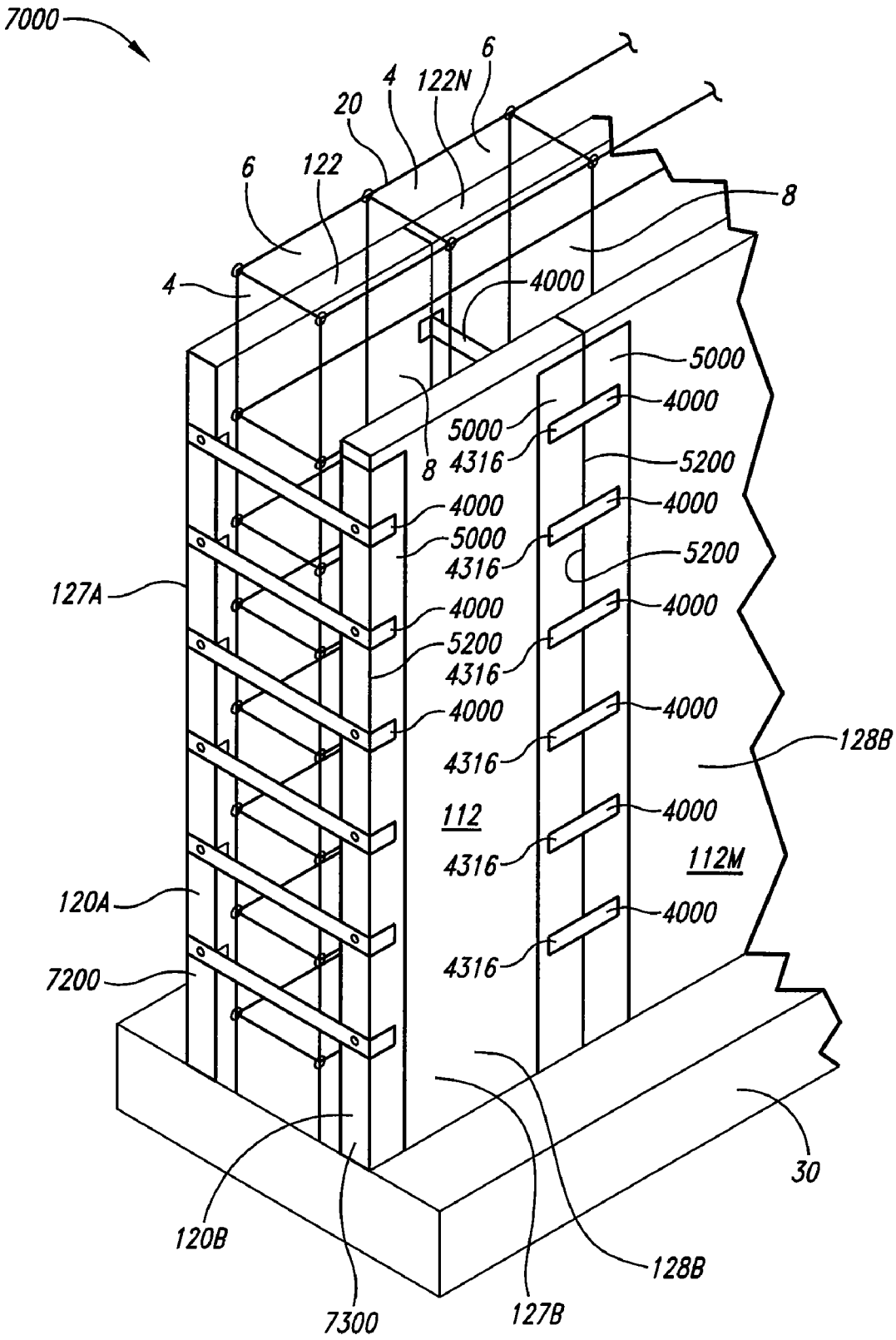
FIG. 13A is a partial perspective view of an alternate embodiment of an insulated wall constructed in accordance with the present invention.
Figure 13B:
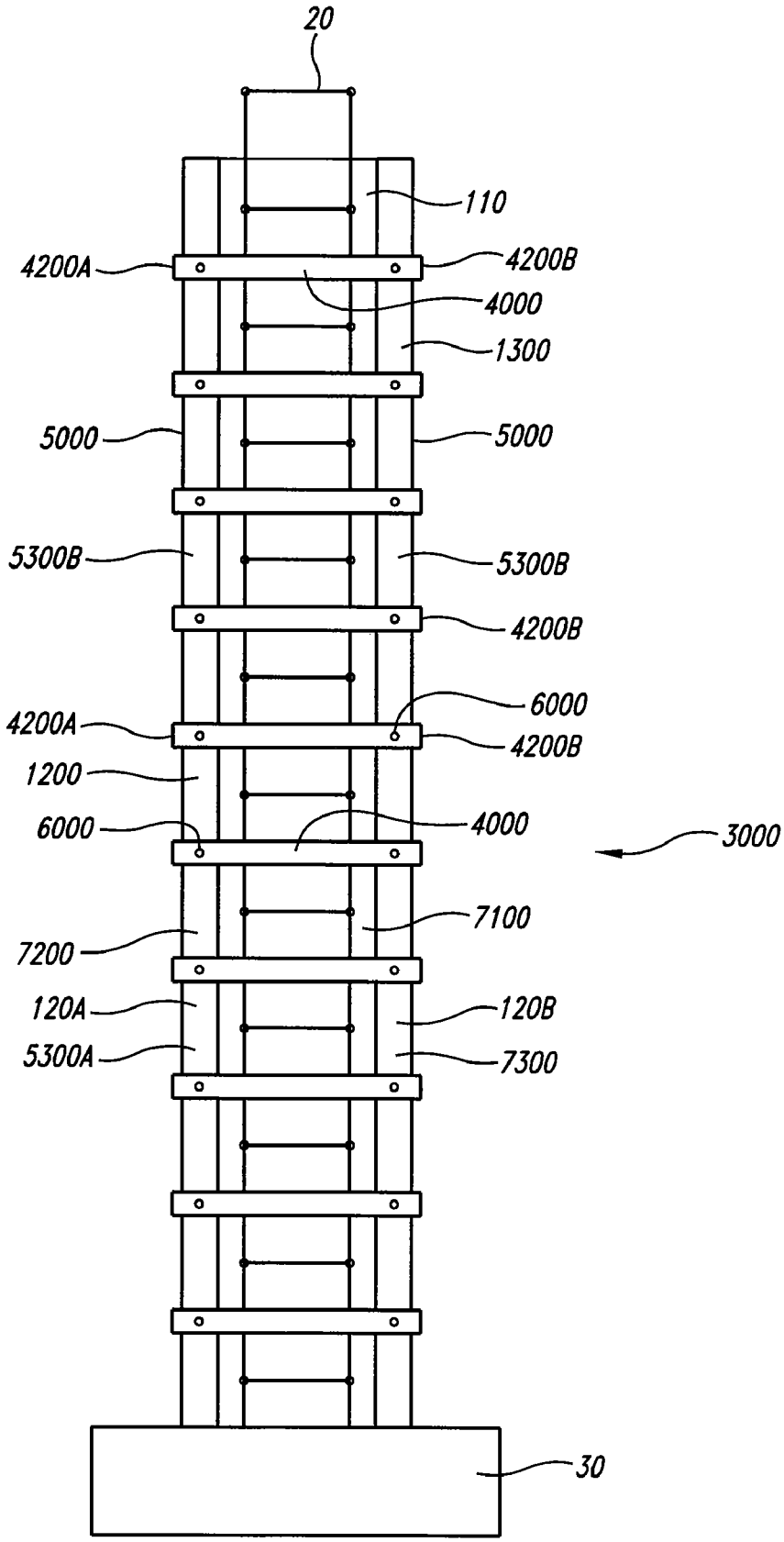
FIG. 13B is a lateral cross-sectional view of the insulated wall of FIG. 13A.

Referring to FIGS. 13A-13D, an alternate embodiment of an insulated wall 3000 constructed in accordance with the present invention will now be described. Like the insulated wall 100, the insulated wall 3000 includes the wall material 110 sandwiched between the first insulating layer 120A and the second insulating layer 120B. In FIG. 13A, the wall material 110 has been omitted to help provide a better understanding of aspects of the insulated wall 3000. The first insulating layer 120A and second insulating layer 120B each comprise a plurality of insulating sheets 122 with upright support members located between neighboring sheets. Optionally and like the insulated wall 100, the insulated wall 100 may include reinforcement materials, such as the two-dimensional grid-like structure 10 and the three-dimensional grid-like structure 20.

The insulated wall 3000 differs from the insulated wall 100 with respect to its ties and upright support members. Instead of including ties 400 and support members 300, the insulated wall 3000 includes ties 4000 (best viewed in FIG. 14) and L-shaped upright support members 5000. Like the ties 400, the ties 4000 connect the first and second insulating layers 120A and 120B. If the insulated wall 3000 includes reinforcement materials, the ties 4000 may be disposed within the interstices 4 of the reinforcement materials, such as the two-dimensional grid-like structure 10 and the three-dimensional grid-like structure 20.

Figure 14:
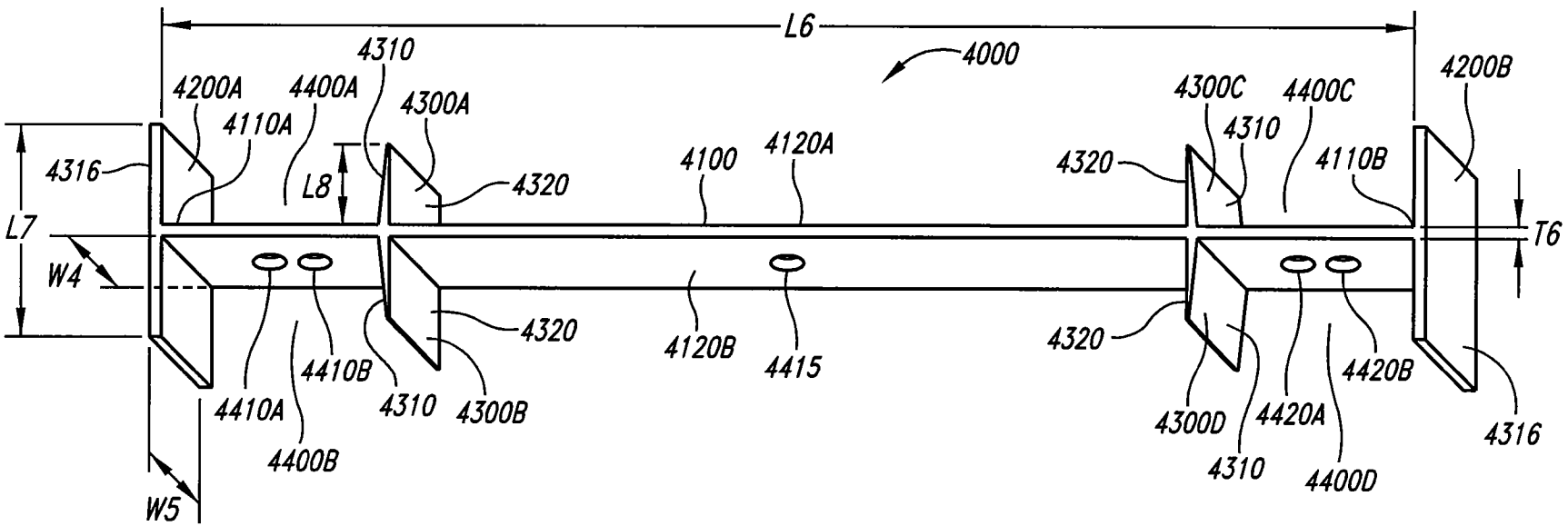
FIG. 14 is a perspective view of a tie of the insulated wall of FIG. 13A.

Referring to FIG. 14, the structure of the ties 4000 will now be described. The tie 4000 includes a longitudinal transverse member 4100 having a first end 4110A opposing a second end 4110B. The longitudinal transverse member 4100 may have a first face 4120A opposing a second face 4120B and both faces 4120A and 4120B may extend between the first end 4110A and second end 4110B.

The longitudinal transverse member 4100 may be generally rectangular in shape having a length "L6" along its longitudinal axis of about 10 inches to about 18 inches and preferably about 14 inches, a width "W4" of about 1 inch to about 3 inches and preferably about 2 inches, and a thickness "T6" of about 0.1 inches to about 0.15 inches and preferably about 0.125 inches.

The tie 4000 may include a first plate 4200A connected to the first end 4110A. The first plate 4200A may be generally orthogonal to the longitudinal axis of the transverse member 4100. The tie 4000 may include a second plate 4200B connected to the second end 4110B. The second plate 4200B may be generally orthogonal to the longitudinal axis of the transverse member 4100. The plates 4200A and 4200B may be substantially identical to each other and may be generally rectangular in shape having a length "L7" of about 1 inch to about 3 inches and preferably about 2 inches, a width "W5" of about 1 inch to about 3 inches and preferably about 2 inches, and a thickness of about 0.1 inches to about 0.15 inches and preferably about 0.125 inches. The plates 4200A and 4200B may each include an attachment portion 4316 offering substantially similar attachment functionality as the attachment portion 316.

The tie 4000 may include a pair of flanges 4300A and 4300B connected to the first side 4120A and the second side 4120B, respectively, of the transverse member 4100 at locations spaced from the first plate 4200A connected to the first end 4110A of the tie 4000. Each of the flanges 4300A and 4300B may be juxtaposed with one another along the opposite sides 4120A and 4120B of the transverse member 4100. The flange 4300A may extend away from the first side 4120A of the transverse member 4100 and the flange 4300B may extend away from the second side 4120B of the transverse member 4100. One or both of the flanges 4300A and 4300B may extend away from the transverse member 4100 in a direction that is substantially perpendicular to the longitudinal axis of the transverse member 4100.

Figure 13C:
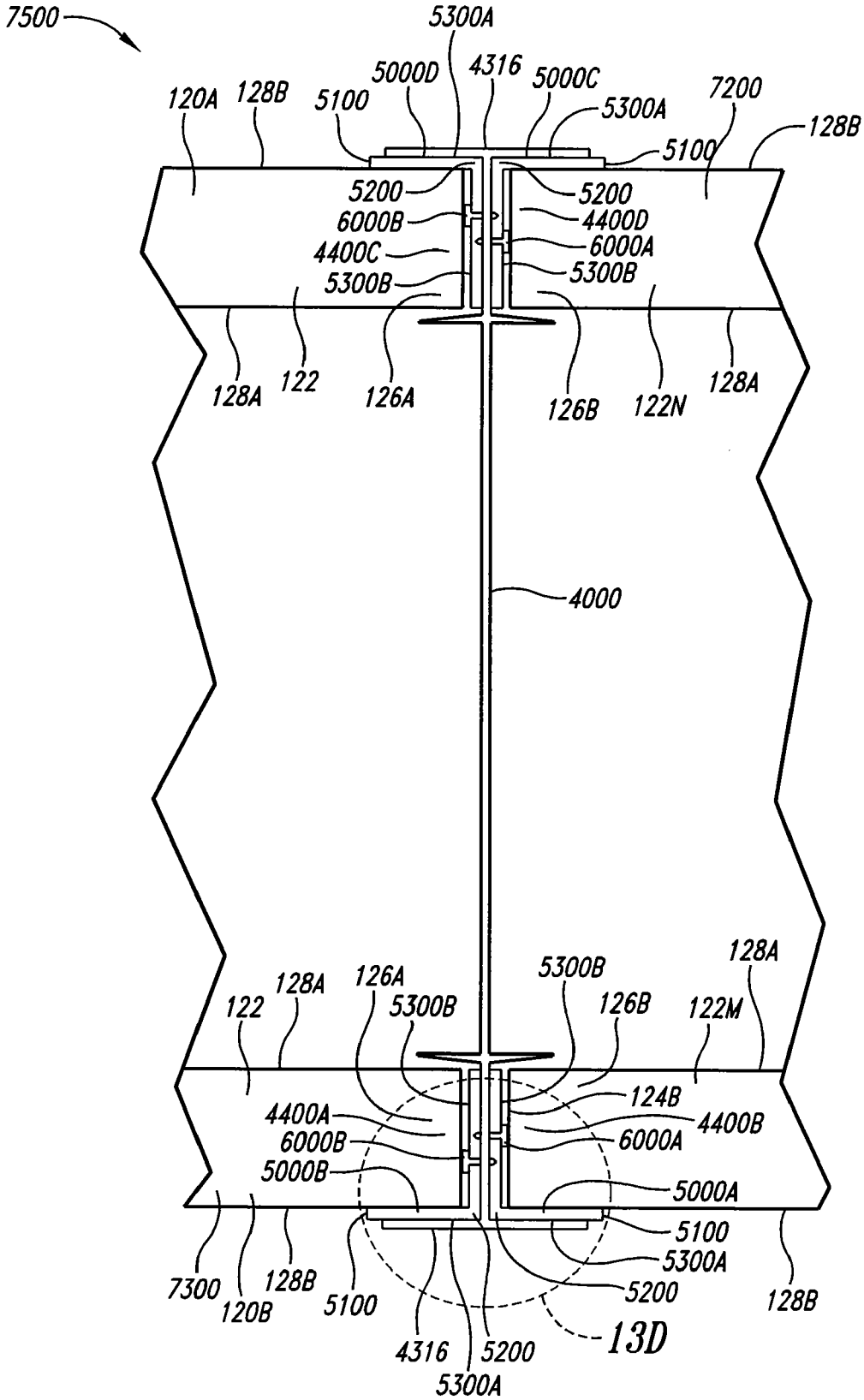
FIG. 13C is a partial longitudinal cross-sectional view of the insulated wall of FIG. 13A.
Figure 13D:
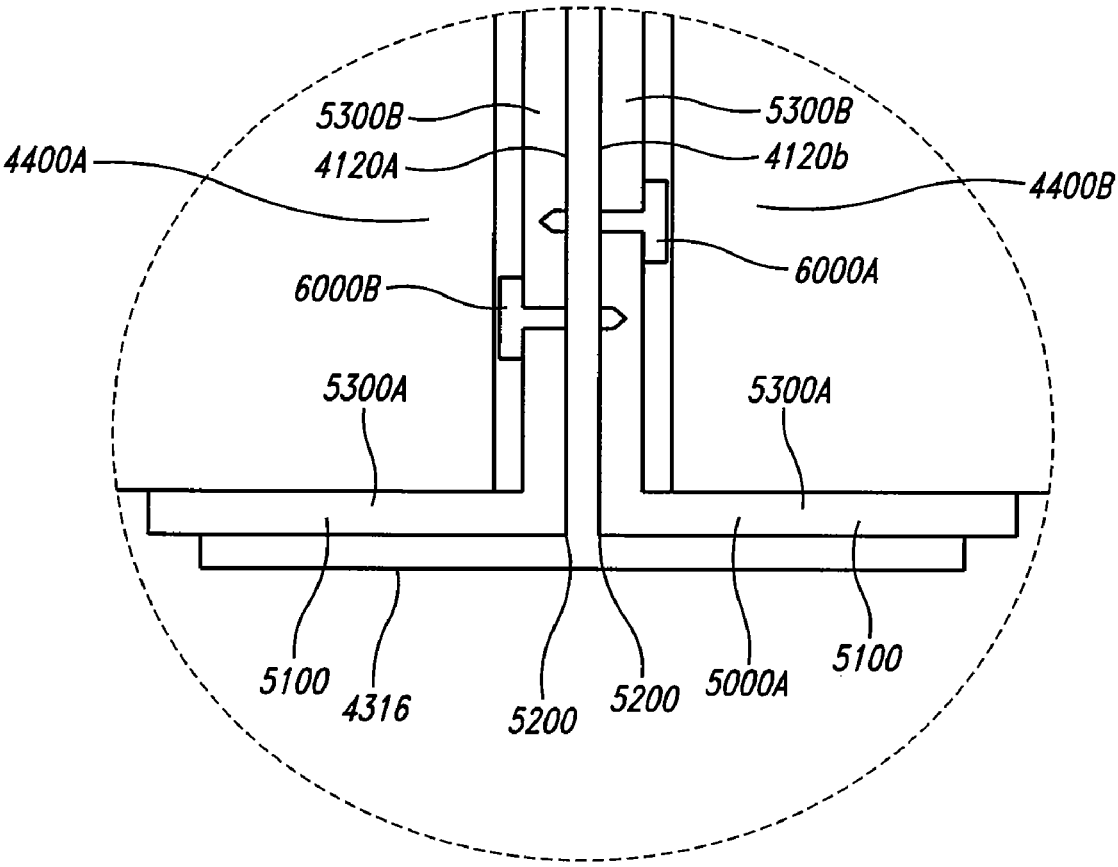
FIG. 13D is an enlarged fragmentary view of a portion of FIG. 13C.

The tie 4000 may include a first pair of through-holes 4410A and 4410B extending between the first side 4120A and the second side 4120B of the transverse member 4100. The first pair of through-holes 4410A and 4410B may be located between the first plate 4200A and the pair of flanges 4300A and 4300B. Each of the through-holes 4410A and 4410B may be substantially similar to the through-hole 410 (see FIG. 4) of the tie 400. Each of the through-holes 4410A and 4410B may be sized and shaped to receive a fastener 6000 as shown in FIG. 13C.

The tie 4000 may include a pair of flanges 4300C and 4300D connected to the first side 4120A and second side 4120B, respectively, of the transverse member 4100 at locations spaced from the second plate 4200B. Each of the flanges 4300C and 4300D may be juxtaposed with one another along the opposite sides 4120A and 4120B of the transverse member 4100. The flange 4300C may extend away from the first side 4120A of the transverse member 4100 and the flange 4300D may extend away from the second side 4120B of the transverse member 4100. One or both of the flanges 4300C and 4300D may extend away from the transverse member 4100 in a direction that is substantially perpendicular to the longitudinal axis of the transverse member 4100.

The tie 4000 may include a second pair of through-holes 4420A and 4420B extending between the first side 4120A and the second side 4120B of the transverse member 4100. The second pair of through-holes 4420A and 4420B may be located between the second plate 4200B and the pair of flanges 4300C and 4300D. Each of the through-holes 4420A and 4420B may be substantially similar to the through-holes 420 (see FIG. 4) of the tie 400. Each of the through-holes 4420A and 4420B may be sized and shaped to receive the fastener 6000 as shown in FIG. 13C.

Optionally, the tie 4000 may include one or more through-holes 4415 located between the pair of flanges 4300A and 4300B and the pair of flanges 4300C and 4300D. The through-hole(s) 4415 may be used to secure the tie 4000 to one or more of the reinforcement bars 2 (see FIGS. 1A and 1B) of the two-dimensional grid-like structure 10, the three-dimensional grid-like structure 20, and the like disposed between the first insulating layer 120A and the second insulating layer 120B in the same manner the through-hole(s) 415 are used to secure the tie 400 to the reinforcement bars 2.

Each of the flanges 4300A, 4300B, 4300C, and 4300D may have a length "L8" of about one inch to about 2 inches and preferably about 1.5 inches. The flanges 4300A and 4300B may be spaced from the first plate 4200A about 1.5 inches to about 2.5 inches and preferably about 2 inches. The flanges 4300C and 4300C may be spaced from the second plate 4200B about 1.5 inches to about 2.5 inches and preferably about 2 inches. The width of the end portion 126 along one of the end walls 124A and 124B of the insulating sheets 122 may determine the spacing between the flanges 4300A and 4300B and the first plate 4200A and the spacing between the flanges 4300C and 4300D and the second plate 4200B.

In various embodiments, the flanges 4300A, 4300B, 4300C, and 4300D may be wedge-shaped or tapered along their length. In the embodiment depicted in FIG. 14, the flanges 4300A, 4300B, 4300C, and 4300D are thickest near the transverse member 4100 and narrow in a linear fashion as they extend away from the transverse member 4100. Each of the flanges 4300A and 4300B may include a first face 4310 that faces the first plate 4200A and a second face 4320 that faces away from the first plate 4200A. The first face 4310 may be angled with respect to both the longitudinal axis of the transverse member 4100 and the first plate 4200A. The second face 4320 may be substantially parallel to the first plate 4200A and substantially perpendicular to the longitudinal axis of the transverse member 4100. Each of the flanges 4300C and 4300D may include a first face 4310 that faces the second plate 4200B and a second face 4320 that faces away from the second plate 4200B. The first face 4310 may be angled with respect to both the longitudinal axis of the transverse member 4100 and the second plate 4200B. The second face 4320 may be substantially parallel to the second plate 4200B and substantially perpendicular to the longitudinal axis of the transverse member 4100.

A first gap 4400A may be formed between the first plate 4200A, the first face 4310 of the flanges 4300A, and the first face 4120A. A second gap 4400B may be formed between the first plate 4200A, the first face 4310 of the flanges 4300B, and the second face 4120B. A third gap 4400C may be formed between the second plate 4200B, the first face 4310 of the flanges 4300C, and the first face 4120A. A fourth gap 4400D may be formed between the second plate 4200B, the first face 4310 of the flanges 4300D, and the second face 4120B. The gaps 4400A, 4400B, 4400C, and 4400D are sized and shaped to receive a portion of the portion 126 along one of the end walls 124A or 124B of the insulating sheets 122.

Within the finished insulated wall 3000, a plurality of ties 4000 are arranged vertically between a neighboring pair of insulating sheets 122 of the first insulating layer 120A and a corresponding neighboring pair of insulating sheets 122 of the second insulating layer 120B. A portion of the end portion 126A or 126B along one of the end walls 124A or 124B of each of the insulating sheets 122 is received into one of the gaps 4400A, 4400B, 4400C, and 4400D.

As is apparent to those of ordinary skill in the art, the flange 4300A and the flange 4300C may be mirror images of one another and the flange 4300B and the flange 4300D may be mirror images of one another. Further, in various embodiments, the tie 4000 may be symmetric about a plane perpendicular to its longitudinal axis that passes through the midpoint between the first end 4110A and second end 4110B along the longitudinal axis.

Figure 15:
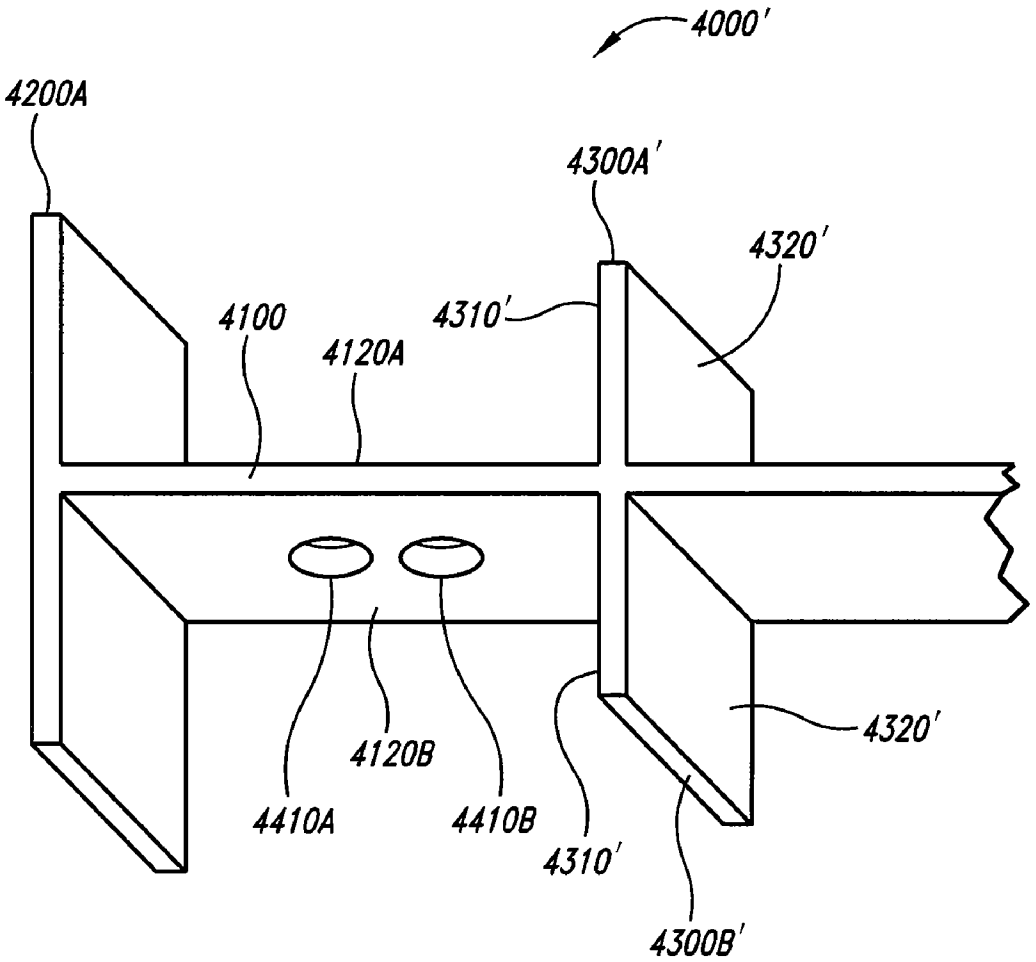
FIG. 15 is a fragmentary perspective view of an alternate embodiment of the tie of FIG. 14.

In an alternate embodiment depicted in FIG. 15, the structure of the tie 4000' may be substantially identical to the structure of the tie 4000 (as indicated by the use of identical reference numerals to identify identical structures) except with respect to the flanges 4300A' and 4300B'. The flanges 4300A' and 4300B' may be located along the transverse member 4100 in the same location and have the same orientation as the flanges 4300A and 4300B of the tie 4000. Further, the second face 4320' of the flanges 4300A' and 4300B' is substantially identical to the second face 4320 of the flanges 4300A and 4300B, respectively. However, the flanges 4300A' and 4300B' are not wedge-shaped or tapered. The first face 4310' of the flanges 4300A' and 4300B' is substantially parallel to the first plate 4200A and substantially perpendicular to the longitudinal axis of the transverse member 4100. In other words, the first face 4310' of the flanges 4300A' and 4300B' is substantially identical and substantially parallel to the second face 4320' of the flanges 4300A' and 4300B', respectively.

Referring to FIGS. 13A-13D, the upright support members 5000 may include an angled or bent outer member 5100 having a bent portion 5200 flanked on one side by a portion 5300A and flanked on the other side by a portion 5300B. In particular embodiments, the upright support member 5000 includes a sheet of galvanized steel bent at approximately a 90° angle along its longitudinal axis near its midline. The portion 5300A may extend about 1.5 inches to about 3.5 inches away from the bent portion 5200. Likewise, the portion 5300B may extend about 1.5 inches to about 3.5 inches away from the bent portion 5200. As is appreciated by those of ordinary skill in the art, suitable L-shaped members are commercially available and readily obtainable.

A first support member 5000A is received inside the gap 4400A of the tie 4000, a second support member 5000B is received inside the gap 4400B of the tie 4000, a third support member 5000C is received inside the gap 4400C of the tie 4000, and a fourth support member 5000D is received inside the gap 4400D of the tie 4000. Because the first and second ends 4110A and 4110B are mirror images of one another, only the structure of the first end 4110A will be described in detail. The first upright support member 5000A is received within the gap 4400A between the first plate 4200A and the transverse member 4100 of the tie 4000 near the intersection of the first plate 4200A and the first face 4320A of the transverse member 4100. A portion of the portion 5300A may be adjacent to the first plate 4200A and the portion 5300B may be adjacent to the first face 4320A of the transverse member 4100. The second upright support member 5000B is received within the gap 4400B between the first plate 4200A and the transverse member 4100 of the tie 4000 near the intersection of the first plate 4200A and the second face 4320B of the transverse member 4100. A portion of the portion 5300A may be adjacent to the first plate 4200A and the portion 5300B may be adjacent to the second face 4320B of the transverse member 4100.

A first fastener 6000A extending between the portion 5300B of the first upright support member 5000A and through the through-hole 4410B (see FIG. 14) in the transverse member 4100 of the tie 4000 may connect the first upright support member 5000A to the tie 4000. A second fastener 6000B extending between the portion 5300B of the second upright support member 5000B and through the through-hole 4410A (see FIG. 14) in the transverse member 4100 of the tie 4000 may connect the second upright support member 5000B to the tie 4000.

The first and second upright support members 5000A and 5000B may include through-holes (not shown) substantially similar to the through-holes 326 (see FIG. 3A) of the support member 300 and configured to receive the fastener 6000. In various embodiments, the through-holes of the first upright support member 5000A may be aligned with the through-holes 4410B of each of the ties 4000 and the through-holes of the second upright support member 5000B may be aligned with the through-holes 4410A of each of the ties 4000. Then, the fasteners 6000A may be inserted through the through-holes of the first upright support member 5000A aligned with the through-holes 4410B of each of the ties 4000 to secure the first upright support member 5000A to each of the ties 4000. Additionally, the fasteners 6000B may be inserted through the through-holes of the second upright support member 5000B aligned with the through-holes 4410A of each of the ties 4000 to secure the second upright support member 5000B to each of the ties 4000. The through-holes may be formed, pre-drilled, bored, and the like into the first and second upright support members 5000A and 5000B using any method known in the art.

In alternate embodiments, the fastener 6000 includes a screw capable of boring holes into the first and second upright support members 5000A and 5000B. In such embodiment, the fastener 6000 bores through the first and second upright support members 5000A and 5000B. In various embodiments, the fastener 6000 may be substantially similar to the fastener 500.

Alternate Embodiment of the Wall Forming System

The insulated wall 3000 may be constructed using the wall forming system 7000. As will become apparent, many of the components of the wall forming system 7000 are incorporated into and become part of the finished insulated wall 3000. Consequently, many of the drawings used to describe the finished insulated wall 3000 will also be used to describe the wall forming system 7000.

The wall forming system 7000 includes a first sidewall 7200 and a second sidewall 7300. In the finished insulated wall 3000, the first sidewall 7200 may form the first insulating layer 120A and the second sidewall 7300 may form the second insulating layer 120B. Consequently, the first sidewall 7200 may include all of the components assembled in the manner discussed above with respect to the first insulating layer 120A. Similarly, the second sidewall 7300 may include all of the components assembled in the manner discussed above with respect to the second insulating layer 120B. Specifically, each of the first and second sidewalls 7200 and 7300 may include a plurality of support members 5000 and a plurality of insulating sheets 122.

A portion of the first wall 7200 may be substantially parallel to and spaced from the second wall 7300. Both the first wall 7200 and the second wall 7300 may rest upon the footing 30. A wall cavity 7100 is defined between the first sidewall 7200 and the second sidewall 7300. The footing 30 may provide a bottom for the cavity 7100. To form the finished insulated wall 3000, the wall material 110 is poured, sprayed, or otherwise inserted into the cavity 7100.

The first and second sidewalls 7200 and 7300 are connected across the cavity 7100 by the plurality of ties 4000. Each of the support members 5000 within a portion of the support members 5000 of the first sidewall 7200 have a corresponding support member 5000 located directly across the cavity 7100. As described above, the plurality of ties 4000 may extend between the support members 5000 of the first wall 7200 and the support members 5000 of the second wall 7300.

Optionally, reinforcement materials such as reinforcement bars 2 may be disposed within the cavity 7100. The reinforcement bars 2 may be assembled into two-dimensional grid-like structures 10 or three-dimensional grid-like structures 20 including voids or interstices 4 (see FIGS. 1A-1B and FIG. 2) between the reinforcement materials. The first opening 6 of the interstices 4 may be near the first sidewall 7200, the second opening 8 may be near the second sidewall 7300, and the unobstructed substantially linear path 7 therebetween may extend between the first and second sidewalls 7200 and 7300. One or more of the ties 4000 used to connect the first and second sidewalls 7200 and 7300 may be disposed along each path 7 of the interstices 4.

Additional external support members (not shown) substantially similar to the external support members 1400 may be connected between the outside surfaces 127A and 127B of one or both of the insulation layers 120A and 120B and the ground 2100 or other anchoring structure(s). In various embodiments, the external support members 1400 may be attached to the attachment portions 4316 of the first and second plates 4200A and 4200B of the ties 4000. The external support members 1400 may be removed after the liquid wall material 110 has solidified.

Method of Constructing Alternate Embodiment Wall Forming System

Generally speaking, before the wall forming system 7000 is constructed, the footing(s) 30 has/have been constructed. If the insulated wall 3000 is to include reinforcement materials, such as the two-dimensional grid-like structures 10 or three-dimensional grid-like structures 20, these structures may be constructed and placed on the footing 30 before the wall forming system 7000 is constructed. In other words, the wall forming system 7000 may be constructed around the two-dimensional grid-like structures 10 or three-dimensional grid-like structures 20.

Figure 16:
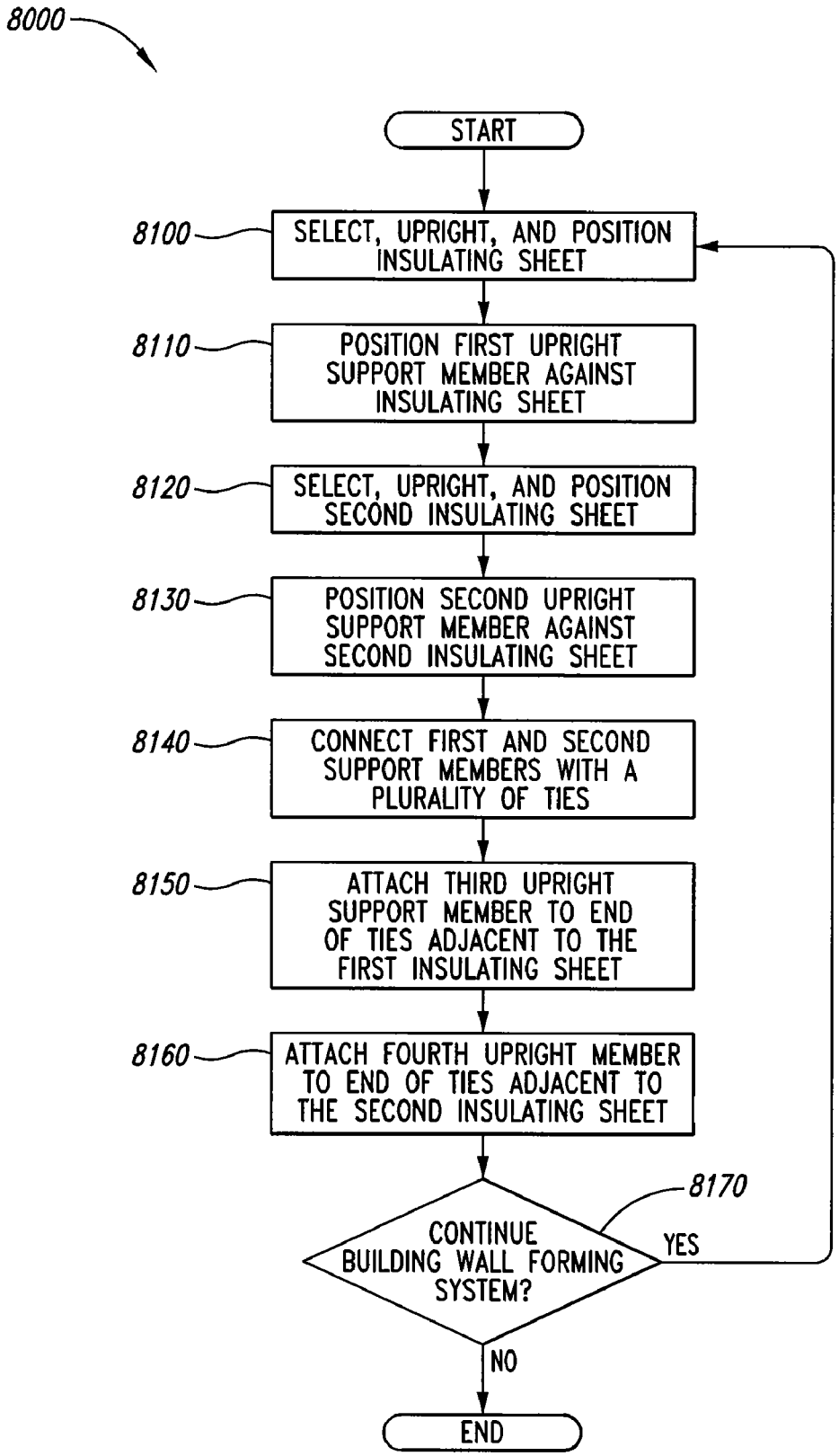
FIG. 16 is a block diagram illustrating a method of constructing a wall forming system for constructing the insulated wall of FIG. 13A.

Referring to FIGS. 16, 13A, and 13C, the method 8000 of constructing a section 7500 starts in a block 8100 with the selection, uprighting, and positioning of a first insulating sheet 122M. In a block 8110, the support member 5000A is positioned against the end portion 126B of the first insulating sheet 122M with the first portion 5300A adjacent to a portion of the outside face 128B of the first insulating sheet 122M and the second portion 5300B adjacent to the end wall 124B. In a block 8120, a second insulating sheet 122N is selected, uprighted, and positioned across the cavity 7100 from the first insulating sheet 122M. In a block 8130, the support member 5000C is positioned against the portion 126B of the first insulating sheet 122N with the first portion 5300A adjacent to a portion of the outside face 128B of the first insulating sheet 122N and the second portion 5300B adjacent to the end wall 124B.

Next, in a block 8140, a plurality of ties are attached one at a time to the upright support members 5000A and 5000C. In particular embodiments, a portion of the transverse member 4100 within the gap 4400B of each of the ties 4000 is fastened with the fastener 6000 to a portion of the first upright support members 5000A and a portion of the transverse member 4100 within the gap 4400D of each of the ties 4000 is fastened with the fastener 6000 to a portion of the second upright support member 5000C. In various embodiments, between about 6 ties 4000 and about 12 ties 4000, and preferably about 10 ties 4000 are attached to the upright support members 5000A and 5000C. The ties 4000 may be spaced apart from one another about 8 inches to about 12 inches and preferable about 10 inches.

Next, in a block 8150, the upright support member 5000B is selected, uprighted, and positioned within the gap 4400A of the ties 4000 attached to upright support members 5000A and 5000C. The first portion 5300A may be adjacent to the first plate 4200A and the second portion 5300B may be adjacent to the transverse member 4100. The upright support member 5000B is fastened using the fastener 6000 to the transverse member 4100 of each of the ties 4000 attached to upright support members 5000A and 5000C.

Next, in a block 8160, the upright support member 5000D is selected, uprighted, and positioned within the gap 4400C of the ties 4000 attached to upright support members 5000A and 5000C. The first portion 5300A may be adjacent to the second plate 4200B and the second portion 5300B may be adjacent to the transverse member 4100. The upright support member 5000D is fastened using the fastener 6000 to the transverse member 4100 of each of the ties 4000 attached to upright support members 5000A and 5000C.

In a decision block 8170, the decision is made whether to continue the sidewalls 7200 and 7300. If it is decided to continue the sidewalls 7200 and 7300, the method 8000 returns to the block 8100. Otherwise, the method 8000 terminates.

The foregoing described embodiments depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality.

While particular embodiments of the present invention have been shown and described, it will be obvious to those skilled in the art that, based upon the teachings herein, changes and modifications may be made without departing from this invention and its broader aspects and, therefore, the appended claims are to encompass within their scope all such changes and modifications as are within the true spirit and scope of this invention. Furthermore, it is to be understood that the invention is solely defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "α" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

Accordingly, the invention is not limited except as by the appended claims.

The invention claimed is:

1. An upright support member for an insulating sheet for use in the construction of a wall-forming system having an internal cavity with a side, wherein the upright support member is positionable along the side of the internal cavity and couplable to a tie disposed inside the internal cavity, the tie has a first end portion positioned adjacent to the side of the internal cavity, and the first end portion of the tie has a through-hole extending laterally through the first end portion, the upright support member comprising:

an upright outer member;

a pair of spaced apart walls adjacent to and extending away from the upright outer member and into the internal cavity of the wall-forming system, each of the walls of the pair of spaced apart walls comprising a proximal end connected to the upright outer member and a distal end spaced from the upright outer member;

a slot defined between the pair of spaced apart walls, the slot being configured to receive the first end portion of the tie, the through-hole of the first end portion of the tie extending laterally between the walls defining the slot;

a pair of channels flanking the pair of spaced apart walls, each of the pair of channels being configured to receive a portion of an end wall of an insulating sheet, the distal end of each of the walls of the pair of spaced apart walls comprising a flange extending away from the slot defined between the pair of spaced apart walls and defining a portion of one of the pair of channels flanking the pair of spaced apart walls; and a through-hole extending laterally through each of the walls of the pair of spaced apart walls, the through-hole of one of the walls being juxtaposed and aligned across the slot with the through-hole of the other wall, wherein the first end portion of the tie is positionable within the slot to align the through-hole of the first end portion extending laterally between the pair of spaced apart walls with the aligned through-holes of the pair of spaced apart walls.

2. The upright support member of claim 1, wherein the first end portion of the tie is received within the slot and the through-hole of the first end portion is aligned with the aligned through-holes of the pair of spaced apart walls, the upright support member further comprising an unobstructed path between the pair of channels flanking the pair of spaced apart walls, the unobstructed path comprising the aligned through-holes of the pair of spaced apart walls and the through-hole of the first end portion of the tie, the unobstructed path being configured to receive a portion of a fastener configured to retain the first end portion of the tie within the slot and maintain the alignment of the through-hole of the first end portion of the tie with the aligned through-holes of the pair of spaced apart walls.

3. The upright support member of claim 1, further comprising an angle defined inside each of the pair of channels flanking the pair of spaced apart walls, the angle being defined between a portion of the upright outer member and one of the walls of the pair of spaced apart walls, and the angle being approximately 90°.

4. The upright support member of claim 1, further comprising an angle defined inside each of the pair of channels flanking the pair of spaced apart walls, the angle being defined between a portion of the upright outer member and one of the walls of the pair of spaced apart walls, and the angle ranging from approximately 5° to approximately 170°.

5. The upright support member of claim 1, wherein the upright support member comprises an upright axis, each of the pair of channels has an opening that extends along the upright axis, the opening is opposite the wall of the pair of spaced apart walls that is adjacent to the channel, the opening of each of the pair of channels is configured to allow the portion of an end wall of the insulating sheet to be inserted therethrough, and each of the flanges extending away from the slot has a tapered inside surface that defines the portion of one of the pair of channels flanking the pair of spaced apart walls, the tapered inside surface defining a portion of the channel near the opening that is larger than a portion of the channel near the wall of the pair of spaced apart walls adjacent to the channel.

6. The upright support member of claim 1, wherein the upright outer member comprises an outside surface opposite the interior cavity of the wall forming system, the outside surface of the upright elongated plate being configured to have wall components attached thereto.

7. The upright support member of claim 1, wherein the upright support member is constructed using extruded PVC.

* * * * *